US009328597B2

(12) United States Patent
Morys

(10) Patent No.: US 9,328,597 B2
(45) Date of Patent: May 3, 2016

(54) ELECTRODE SYSTEM AND SENSOR FOR AN ELECTRICALLY ENHANCED UNDERGROUND PROCESS

(75) Inventor: Marian Morys, Downingtown, PA (US)

(73) Assignee: Electro-Petroleum, Inc., Villanova, PA (US)

( * ) Notice: Subject to any disclaimer, the term of this patent is extended or adjusted under 35 U.S.C. 154(b) by 724 days.

(21) Appl. No.: 13/438,220

(22) Filed: Apr. 3, 2012

(65) Prior Publication Data

US 2012/0256634 A1 Oct. 11, 2012

Related U.S. Application Data

(60) Provisional application No. 61/472,804, filed on Apr. 7, 2011.

(51) Int. Cl.
*G01V 3/00* (2006.01)
*E21B 43/25* (2006.01)
*E21B 43/24* (2006.01)

(52) U.S. Cl.
CPC ..... *E21B 43/25* (2013.01); *E21B 43/2401* (2013.01)

(58) Field of Classification Search
None
See application file for complete search history.

(56) References Cited

U.S. PATENT DOCUMENTS 3,618,001 A 11/1971 Zill et al.
3,782,465 A 1/1974 Bell et al.
4,199,025 A * 4/1980 Carpenter ..... 166/248
4,208,775 A * 6/1980 McCombs et al. ..... 29/240
4,495,990 A 1/1985 Titus et al.
4,691,203 A 9/1987 Rubin et al.
4,704,708 A 11/1987 Dennis
5,614,077 A 3/1997 Wittle et al.
6,557,630 B2 5/2003 Harkins et al.
6,877,556 B2 4/2005 Wittle et al.
6,909,667 B2 6/2005 Shah et al.
7,259,689 B2 8/2007 Hernandez-Marti et al.
7,436,185 B2 10/2008 Fredette et al.
2006/0028333 A1 * 2/2006 Tyndall ..... 340/447
2010/0063347 A1 * 3/2010 Yomtov et al. ..... 600/17
2011/0234018 A1 * 9/2011 Siebachmeyer ..... 307/139
2013/0239673 A1 * 9/2013 Garcia-Osuna et al. ... 73/152.46

* cited by examiner

*Primary Examiner* — Curtis King
(74) *Attorney, Agent, or Firm* — Clement A. Beard, Esq.; Dann, Dorfman, Herrell & Skillman, PC

(57) ABSTRACT

An electrically stimulated electrode system comprises injection and return electrodes and a power supply for causing electrical current to flow through a subterranean formation. An electronic system for the injection electrode includes: a power harvester extracting electrical power from current flowing in the injection electrode, a control for the injection electrode current, a sensor of the injection electrode and/or formation, or a telemetry for the injection electrode and/or formation, or any combination thereof. A sensor comprises: a pair of spaced apart electrodes, a power conversion device connected to the spaced apart electrodes for providing electrical power, and a processor providing a representation of a current. The electronic system may include: a power harvester, a commandable and/or programmable current control; and a control system for commanding and/or programming the current control, whereby the current flowing in the injection electrodes may be independently controlled and/or sequenced in time.

29 Claims, 14 Drawing Sheets

122
110
Zn
SN
Zb
S2
Za
S1

110
300
Za
Zb
Zn
S1
S2
SN
122

122
110
Electrode
To Other Electronics
310
Current Sensor
330
300

T3
320
Controller
210
Power
Harvesting 220
230
Power
Distribution
122

ELECTRODE SYSTEM AND SENSOR FOR AN ELECTRICALLY ENHANCED UNDERGROUND PROCESS

This application hereby claims the benefit of U.S. Provisional Patent Application No. 61/472,804 filed Apr. 7, 2011, entitled "ELECTRODE SYSTEM FOR AN ELECTRICALLY ENHANCED UNDERGROUND PROCESS," which is hereby incorporated herein by reference in its entirety.

The present invention relates to an electrode system and/or sensor for an electrically enhanced underground process.

Hydrocarbons and other chemicals, either desirable for a use or undesirable contaminants, may be present in subterranean formations, but may not flow or be easily recoverable under natural or applied pressure or in response to heat, injected steam, and other stimulation. One example method for recovering oil from such a subterranean oil-bearing or chemical bearing formation employs an electro-chemical, electro-kinetic or electro-thermal process. Therein, one or more pairs of electrodes are inserted into the ground in proximity to a medium of interest, e.g., a body of oil in the formation.

A voltage difference is then established between the electrodes to create an electric field in the medium, e.g., an oil-bearing formation. The voltage may be a voltage, typically a DC voltage, causing an electrical current to flow, e.g., for enhancing the transport of ions and other charged particles, and may also include an AC voltage component to induce and/or enhance electro-chemical reactions that may enhance the process. As voltage is applied, current flow through the formation is manipulated to induce reactions in components of the oil or other chemical to be extracted, which can lower the viscosity of the oil and thereby reduce capillary resistance to oil flow so that the oil can be removed at an extraction well.

Examples of electrically stimulated systems are described in U.S. Pat. No. 3,782,465 issued to Christy W. Bell et al on Jan. 1, 1974 and entitled "Electro-thermal Process for Promoting Oil Recovery," in U.S. Pat. No. 4,495,990 issued to Charles H. Titus et al on Jan. 29, 1985 and entitled "Apparatus for Passing Electrical Current Through an Underground Formation," in U.S. Pat. No. 5,614,077 issued to J. Kenneth Wittle et al on Mar. 25, 1997 and entitled "Electrochemical System and Method for the Removal of Charged Species from Contaminated Liquid and Solid Wastes" and in U.S. Pat. No. 6,877,556 issued to J. Kenneth Wittle et al on Apr. 12, 2005 and entitled "Electrochemical Process for Effecting Redox-Enhanced Oil Recovery," each of which is hereby incorporated herein by reference in its entirety.

Operation of an electrode system may be inefficient and/or ineffective because the conditions in the well and the current distribution in the subterranean formation are not sufficiently known and/or are not properly controlled, at least in part because these conditions are unknown to an operator at the surface. Further, where plural electrodes are employed, the conditions may be substantially different at different ones of the electrodes, also unknown to and not determinable by an operator at the surface.

Applicant believes that such problems may be addressed by improved control of the current distribution in the subterranean formation, which may require control of current at a particular electrode, or which may be made possible and/or enhanced by the application of in situ controls and/or in situ sensors and/or of in situ telemetry systems, which in turn may require a source of electrical power for their operation, none of which is known to exist.

While batteries or a separate low power distribution cables could be employed to provide electrical power or telemetry, the logistics of maintaining and replacing such batteries or power distribution located in situ in a well bore hole would likely require the pulling of equipment up from the bore hole and/or the shutting down of production operations, and so is likely to be expensive and burdensome, particularly considering the harsh environmental conditions likely to exist at the locations at which such batteries and power distribution would likely be operated.

Accordingly, an electrode system may comprise: an injection electrode and a return electrode for a subterranean formation; a power supply for applying electrical potential between the injection electrode and the return electrode for causing electrical current to flow through the subterranean formation. An electronic system associated with the injection electrode may include: a power harvester for extracting electrical power from current flowing in the injection electrode, or a current control for controlling the current flowing through the injection electrode, or a sensor of a parameter of the injection electrode or the subterranean formation or both, or a telemetry for receiving a representation of a parameter relating to the at least one injection electrode or the subterranean formation or both, or any combination thereof.

A sensor device for sensing current flow may comprise: a pair of spaced apart electrodes for being disposed in an orientation wherein current flows in a direction generally aligned with the direction in which the spaced apart electrodes are spaced apart, a power conversion device connected to the spaced apart electrodes for receiving voltage produced thereacross for receiving electrical power and for providing electrical power therefrom; and an electronic processor responsive to the voltage produced across the spaced apart electrodes for providing a representation of the current.

According to another aspect, an electrically stimulated electrode system may comprise: a plurality of injection electrodes for being disposed in a subterranean formation; a return electrode coupled to the subterranean formation; and a power supply connected to the injection electrodes and to the return electrode for applying electrical potential between the injection electrodes and the return electrode for causing electrical current to flow through the subterranean formation. An electronic system associated with each of the injection electrodes may include: a power harvester for extracting electrical power from the current flowing in the injection electrode for powering the electronic system; and a current control for controlling the current flowing through the injection electrode, wherein the current control is commandable or is programmable or is commandable and programmable; and a control system for commanding or programming or commanding and programming each current control to set the current flowing in the injection electrode to a given current level, to flow at a given time, or to flow at a given level at a given time, whereby the current flowing in the injection electrodes may be independently controlled and/or sequenced in time.

BRIEF DESCRIPTION OF THE DRAWING

The detailed description of the preferred embodiment(s) will be more easily and better understood when read in conjunction with the FIGURES of the Drawing which include.

Figure 1:
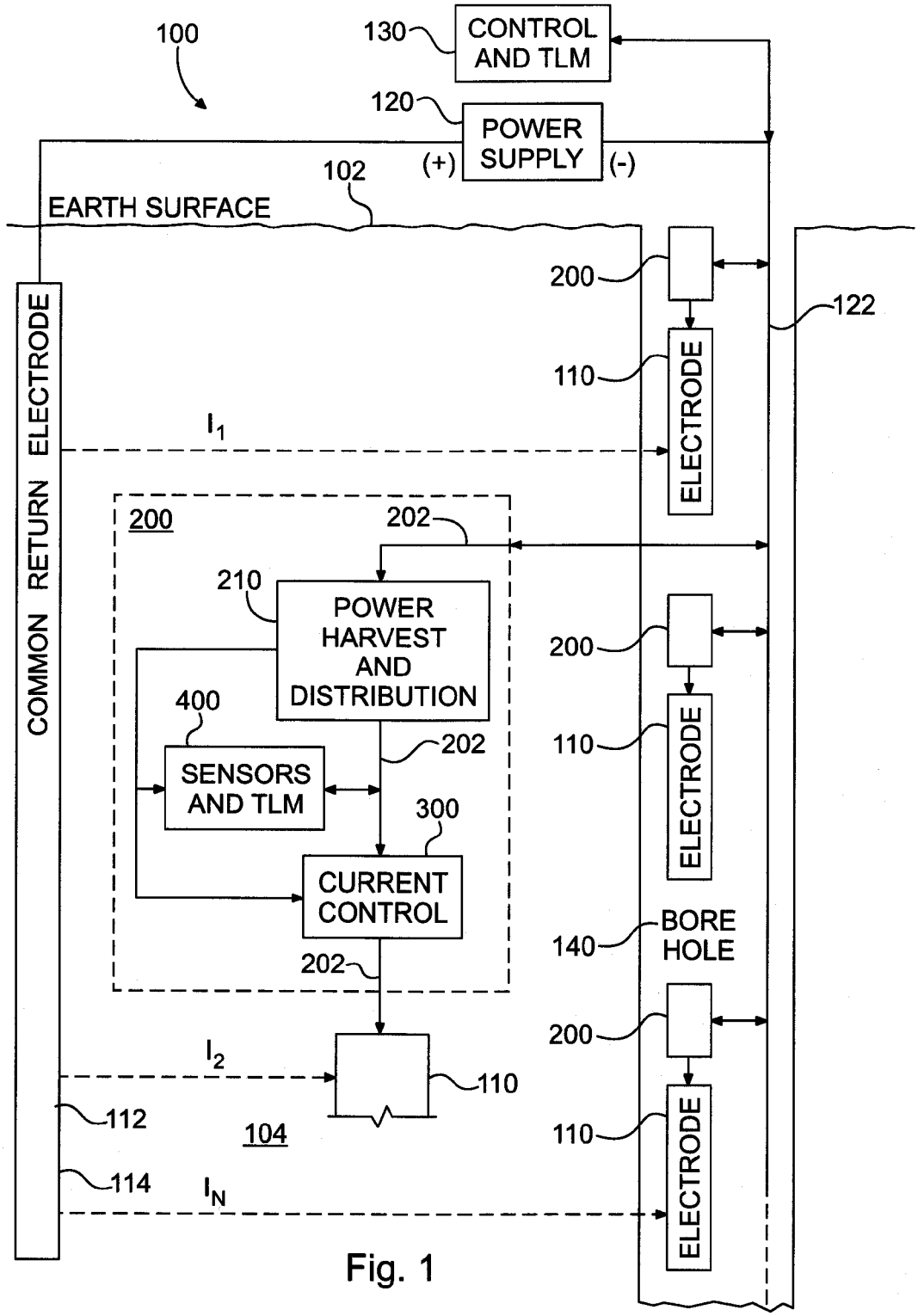
FIG. 1 is a schematic diagram of an example embodiment of an electrically stimulated electrode system.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

FIG. 1 is a schematic diagram of an example embodiment of an electrically stimulated electrode system 100. Bore hole 140 is drilled for the extraction of a desired chemical and may have extraction equipment associated therewith, such as pumps, pressurizers and the like, which may employ known conventional devices and techniques. Electrical stimulation system 100 includes one or more electrodes 110, preferably plural electrodes 110, positioned at various level sin bore hole 140 wherein each electrode 110 receives electrical power, typically hundreds or thousands of amperes of current at a substantial high voltage, from system power supply 120 via common power bus 122, typically a substantial electrical cable inserted into bore hole 140. The basic circuit of electrode system 100 is completed by a "return" electrode 112 which may be a common "return" electrode 112 located near the earth surface 102 or extending down a second bore hole 114, or may be plural "return" electrodes 112 located at various levels down the second bore hole 114, that connect to power supply 120 via return conductor 126.

The one or more "return" electrodes 112 are connected to the positive (+) polarity output from power supply 120 so as to be one or more anode electrodes 112 and the electrodes 110 are connected to the negative (−) output from power supply 120 so as to be one or more cathode electrodes 110. The electrodes 112 are referred to as "return" electrodes and electrodes 110 as "injection" electrodes as a matter of convenience even though strictly speaking, conventional electrical current flows from power supply 120 down and through common return electrode 112, into and through the formation 104 between anode electrode 112 and cathode electrode 110, into electrodes 110 and then up common power bus 122 to the negative output of power supply 120. Electrons flow in the reverse direction, however, and so the appellations "return" electrode and "injection" electrode are apt concerning electron flow.

Associated with each cathode electrode 110 is an electronic system 200 through which current flows between electrode 110 and power bus 122, and that provides power harvesting and power distribution 210, control 300 of the electrode 110 current and various sensors and/or telemetry 400 for system 100. Electronics system 200 includes a high current carrying conductor 202 between electrode 110 and power bus 122 for carrying the electrode 110 current which may reach levels of, e.g., hundreds or thousands of amperes.

Connected to high current conductor 202 may be power harvesting and distribution circuitry 210 which extracts a small amount of electrical power, e.g., several or tens of watts, from the power flowing through high current conductor 202 and electrode 110 which may reach high levels of power, e.g., many kilowatts or megawatts. The power extracted by power harvesting 210 is employed to power the power harvesting circuitry 210 and is also distributed to power current control 300, to power sensor 400, to power telemetry 400, or to power any combination thereof, as may be employed in any particular circumstance.

Current control 300 typically includes a control device in series with conductor 202 for controlling the level of current flowing therethrough between electrode 110 and power bus 122, and may also include control circuitry for controlling the operation of the current control device. As a result, the current flowing through any electrode 110 is determined by current control 300 and not simply by the voltage that happens to be present at the connection of that electrode 110 to power bus 122 and by the impedance of the subterranean formation 104 between return electrode 112 and injection electrode 110, which may be non-linear, both of which are variable over time and local conditions, and are uncontrollable as a practical matter.

Sensors and/or telemetry 400 may include sensors, or telemetry, or both. The sensor aspect 400 may include electronic and/or electro-mechanical sensor devices that are provided to sense and/or measure a condition of interest, e.g., current flow through electrode 110, temperature, pressure, fluid flow in bore hole 102, and/or any other measurable condition that may be of interest. The telemetry aspect 400 may include a data transmission system for transmitting data sensed at or near a particular electrode 110 to a control and telemetry system 130 at the surface whereat the data received may be employed to monitor operation of the well and/or electrodes and system, and to adjust the operating conditions thereof so as to exercise control thereover.

FIG. 2 includes FIGS. 2A-2E which are schematic diagrams of example embodiments of a power harvesting arrangement 210 for extracting electrical power from the electrodes 110 useful with the example electrically stimulated electrode system 100 of FIG. 1. Any power harvesting arrangement 210 herein may be employed with any current control arrangement 300 described herein and with any sensor and/or telemetry arrangement 400 described herein, as well as with other arrangements thereof.

Figure 2A:
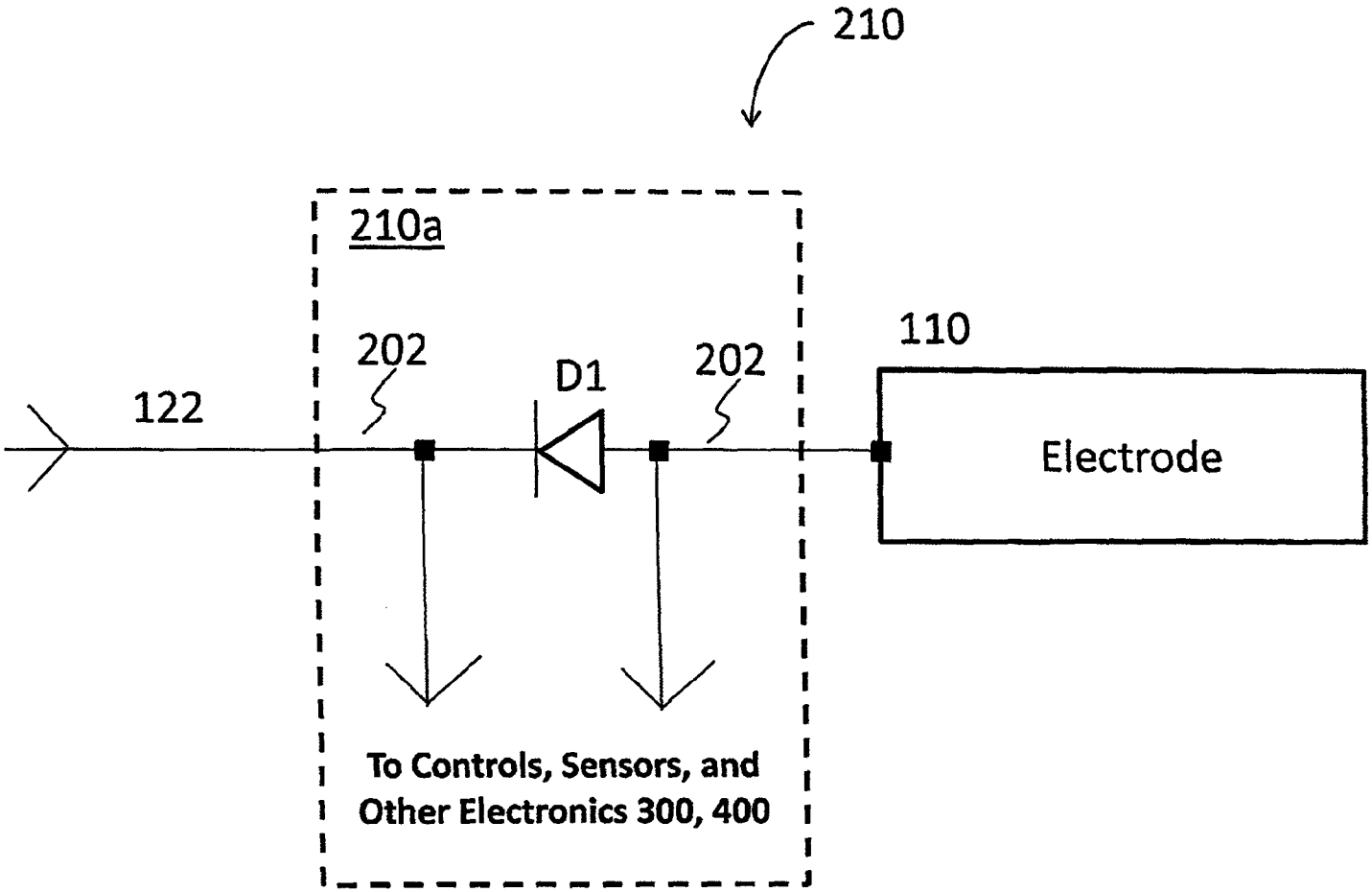
FIG. 2 includes FIGS. 2A-2F which are schematic diagrams of example embodiments of a power harvesting arrangement for extracting electrical power from the electrodes useful with the example electrode system of FIG. 1.

In FIG. 2A, a simple power harvester 210*a* includes a diode D1 or other impedance that is connected in series in conductor 202, which is itself a part of common power bus 122, so that the current passing through the subterranean formation 104 into electrode 110 also passes through diode D1. This current creates a forward voltage drop through forward conduction of diode D1. The voltage developed thereacross can be harvested by simply being applied directly to power various controls, sensors, telemetry and other electronics 300, 400 of electronic electrode system 200. This arrangement does have the drawback in that even when a low-forward drop diode, e.g., a Schottky diode D1 is employed, substantial power (heat) will be generated by diode D1 and will need to be dissipated because of the very high current, e.g., hundreds or thousands of amperes, flowing therethrough, even though its forward voltage is typically low, e.g., about 0.5 volts.

Figure 2B:
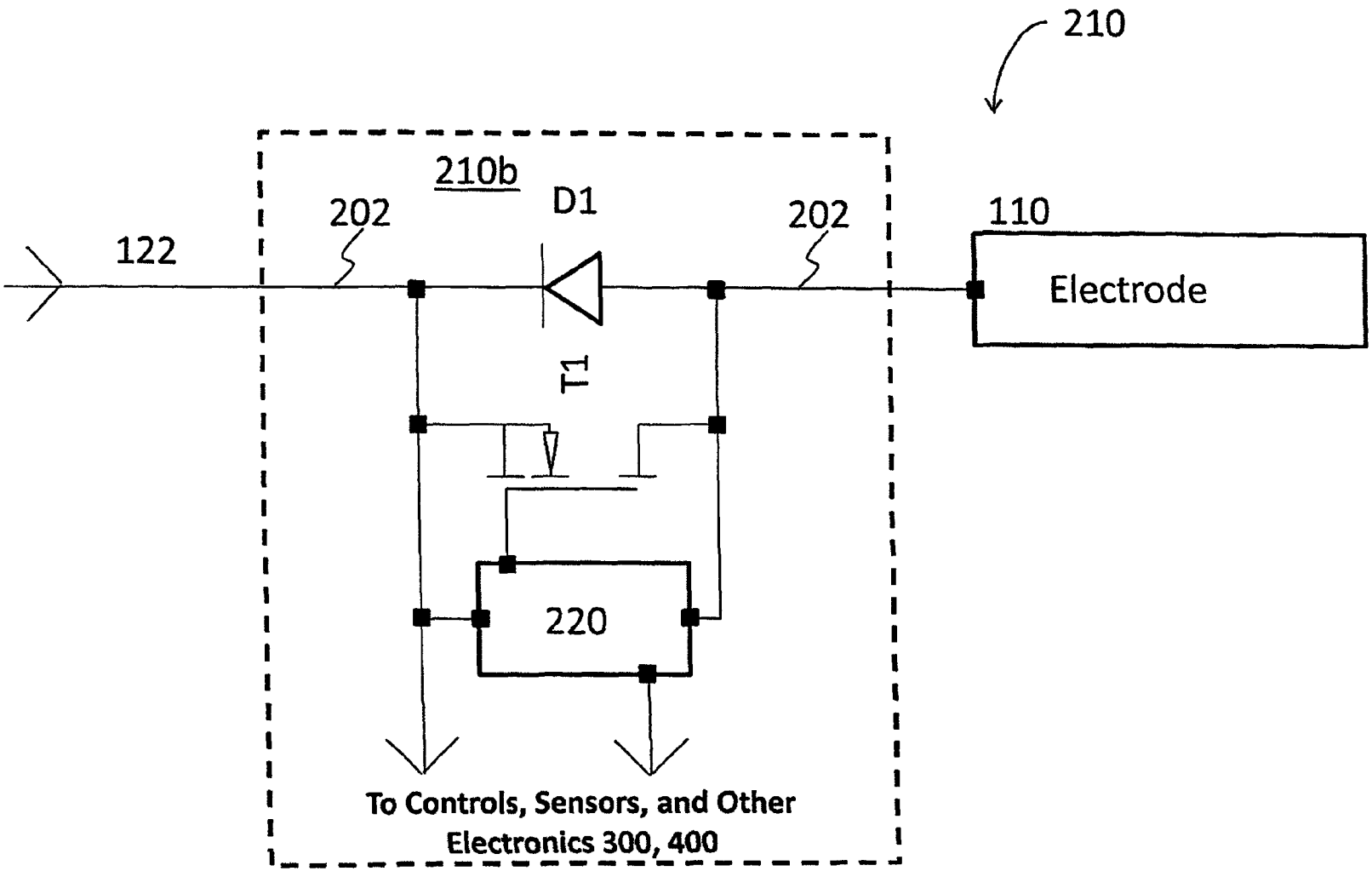

In power harvesting circuit 210*b* of FIG. 2B, the voltage drop across an electronic element D1, T1 of power harvester 210*b* is employed as above to power various controls, sensors, telemetry and other electronics 300, 400 of electronic system 200. In this embodiment, however, while diode D1 initially provides a limited voltage, e.g., its forward voltage drop, to provide sufficient voltage to start power converter and control circuit 220 operating, which causes circuit 220 to generate sufficient voltage at the gate of a metal-oxide semiconductor field effect transistor (MOSFET) T1 to cause transistor T1 to turn on and exhibit a low on resistance Rds-on across which a much smaller voltage appears due to the current flowing in electrode 110 and power bus 122. When FET T1 is ON, it diverts current from diode D1 and the voltage across T1 may be about 0.05 volt, thereby reducing the power (heat) dissipated in diode D1 and FET T1 by about an order of magnitude from that of diode D1 alone in power harvester 210*a*.

Control circuitry 220 of power harvester 210*b* operates from the low voltage developed across FET T1 when it is in its ON condition, e.g., which preferably is at or close to the minimum voltage necessary for control circuit 220 to operate. To this end, control circuit 220 may include an ultra-low voltage charge pump circuitry, e.g., a type LTC3108 charge pump circuit available from Linear Technology, located in Milpitas, Calif., which is capable of boosting low voltages, e.g., voltages on the order of about 0.05 volts or less, to higher voltages. As will be appreciated by one of ordinary skill in the art, FET T1 may comprise a plurality of FETs connected in parallel and operated together in order to obtain a very low Rds-on, e.g., perhaps on the order of one milli-ohm, as needed to carry the very high currents that flow through any given electrode 110 and conductor 202.

This arrangement advantageously tends to be inherently self regulating because if the voltage applied by circuit 220 to the gate of FET T1 tends towards becoming too low, FET T1 will tend to become less conductive which will cause the voltage developed across FET T1 to tend to increase which will in turn cause control circuit 220 to tend to increase the gate voltage generated by circuit 220 which will tend to restore FET T1 towards greater conduction and a lower voltage thereacross. Conversely, if the gate voltage tends toward becoming too high, then the reverse process occurs which tends to make FET T1 more conductive thereby to decrease the voltage across FET T1 which tends to decrease the voltage to control circuit 220 which tends to decrease the gate voltage developed by control circuit 220. The same effect obtains when the source of variation is, e.g., the voltage across FET T1 increasing or decreasing because the current flowing through electrode 110 to common power bus 122 increases or decreases.

The boosted FET T1 conduction voltage that is developed and applied to the gate of FET T1 developed by power converter and control circuit 220 and/or other voltages developed by power converter and control circuit 220 may be distributed and applied to various controls, sensors, telemetry and other electronics 300, 400 of system 200. However, a low-voltage charge pump circuit typically can produce only about one watt or a few watts of output power which may limit the electronics that can be powered thereby as thus far described, although plural charge pump circuits could be operated in parallel to produce more power.

Figure 2C:
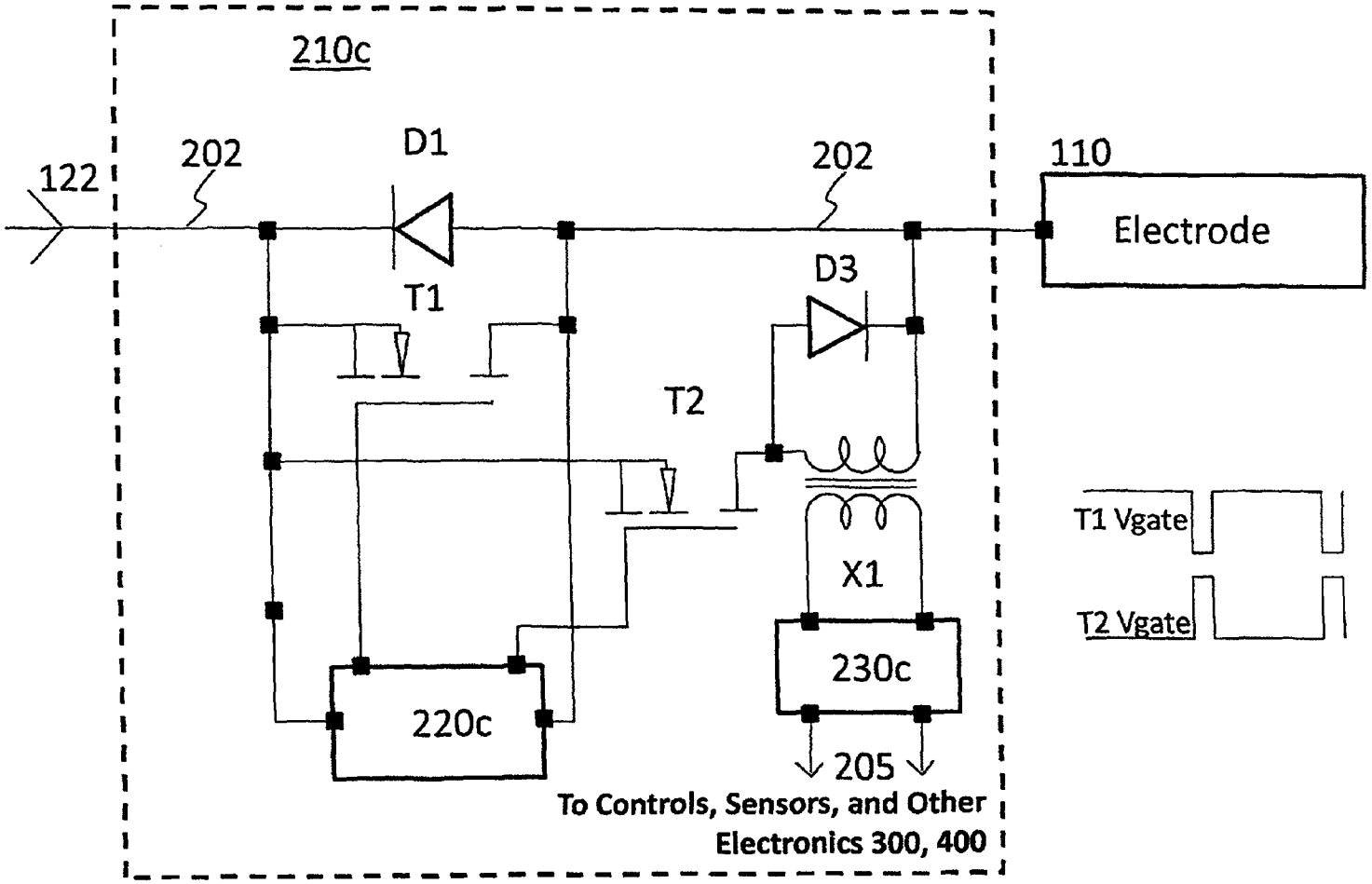

In FIG. 2C, a power harvesting circuit 210*c* capable of producing a higher output power, typically on the order of tens to hundreds of watts, while maintaining the benefits of a low voltage drop on conductor 202 and the low power dissipation associated therewith is shown. Diode D1, FET T1 and power conditioner and control circuit 220 all operate as described above. The primary winding of a transformer X1 is connected in series with FET T2 and are then in parallel with diode D1 and FET T1. Control circuit 220*c* generates gate voltages for both FETs T1 and T2, but not at the same time. When the gate voltage for FET T1 is high, the gate voltage for FET T2 is low and vice versa, as illustrated by the waveforms T1 Vgate and T2 Vgate in FIG. 2C. Each of FETs T1 and T2 is OFF when its gate voltage is low and is ON when its gate voltage is high.

Control circuit 220*c* switches FETs T1 and T2 alternately ON and OFF periodically redirecting the current flowing through FET T1 in whole or in part through the primary winding of transformer X1, thereby to apply thereto a pulsed voltage waveform having a substantial AC component. Diode D3 is connected to conduct the current flowing in the primary winding of transformer X1 when FET T2 is turned OFF. The resulting voltage pulses applied to the primary winding of transformer X1 are transformed upward (stepped up) in voltage at the secondary winding thereof and may be rectified by power supply 230*c* to be applied as DC voltage to various controls, sensors, telemetry and other electronics 300, 400 of system 200.

The voltage provided by power supply 230*c* may be controlled by controlling the duty cycle of FET T2, e.g., by increasing and decreasing its ON time as a percentage of the frequency at which FETs T1 and T2 are alternated ON and OFF. In addition, power supply 230*c* may include, voltage regulators, current limiters, and other power conditioning circuitry as might be necessary and appropriate for power control 210*c* to provide electrical power in a form suitable for the various controls, sensors, telemetry and other electronics it may power. Further, transformer X1 may have plural secondary windings for providing electrical power at different voltages, which may be rectified and filtered for providing DC voltage or may be supplied unrectified as AC voltage, with or without being filtered, e.g., by a capacitor or an inductor-capacitor filter.

As will be appreciated by one of ordinary skill in the art, FETs T1 and T2 may each comprise a plurality of FETs connected in parallel and operated together in order to obtain a very low Rds-on, e.g., perhaps on the order of one milli-ohm, as needed to carry the very high currents that flow through any given electrode 110 and conductor 202.

Figure 2D:
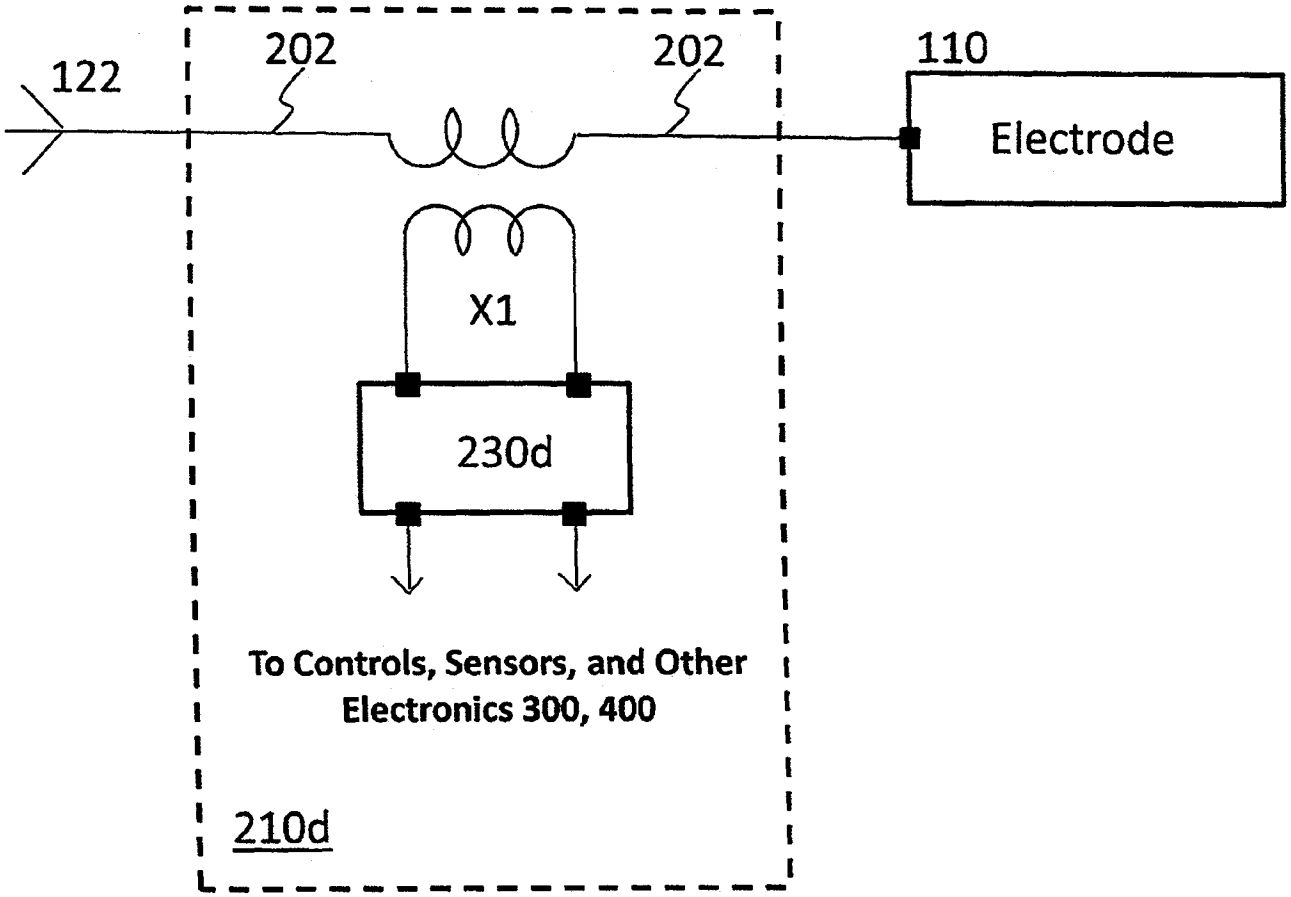

In FIG. 2D, power supply 230*d* may be similar to power supply 230*c* described except that transformer X1 has its primary winding connected in series in conductor 202 through which the current that flows through electrode 110 passes. In this embodiment, because the current flowing through electrode 110 and in common power bus 122 is not a pure DC current, but has an AC or time variant component, e.g., ripple, that AC component or ripple is transformed to a higher voltage (stepped up) by transformer X1 and is applied from the secondary winding thereof to power supply 230*d*.

Power supply 230*d* may include, voltage regulators, current limiters, and other power conditioning circuitry as might be necessary and appropriate for power control 210*d* to provide electrical power in a form suitable for the various controls, sensors, telemetry and other electronics it may power. Further, transformer X1 may have plural secondary windings for providing electrical power at different voltages, which may be rectified and filtered for providing DC voltage or may be supplied unrectified as AC voltage, with or without being filtered, e.g., by a capacitor or an inductor-capacitor filter.

The time-based or AC component may be intentionally induced in the power supplied via common power bus 122 for operating power harvester 210*d* or may be a residual ripple, e.g., from the AC to DC rectification, of the surface power supply 120 that supplies electrical power to all of electrodes 110 and 112 of electrode system 100.

Power supply 230 thus provides AC and/or DC voltages to be applied to various controls, sensors, telemetry and other electronics 300, 400 of system 200.

In the foregoing and following embodiments, each electronic system 200, including, e.g., power harvesting circuitry 210 and other elements of electronic system 200 described herein, may be attached to or close to a respective electrode 110, e.g., in a package or container that is physically attached thereto, so long as each is connected in series with the respective electrode 110 to receive the current flowing through that electrode 110. Thus, plural power harvesting systems 210 may be employed in series with respective electrodes 110 in the same string of electrodes 110, as shown, e.g., in FIG. 1. Plural power harvesting and distribution 210 and/or plural sensor and telemetry 400, 400' (described below) may be essentially in series on the same common power bus and/or string of electrodes 110.

The housing or container for electronic system 200 is suitably strong and of materials for operating in the temperature and pressure environments present in the vicinity of electrodes 110, at least some of which may be at great depth from the Earth's surface and be under pressure of a column of bore hole fluid that fills well bore hole 110. Such housing or container may be attached to electrode 110 or may be disposed in a compartment therein, or may be separate from electrode 110.

Figure 2E:
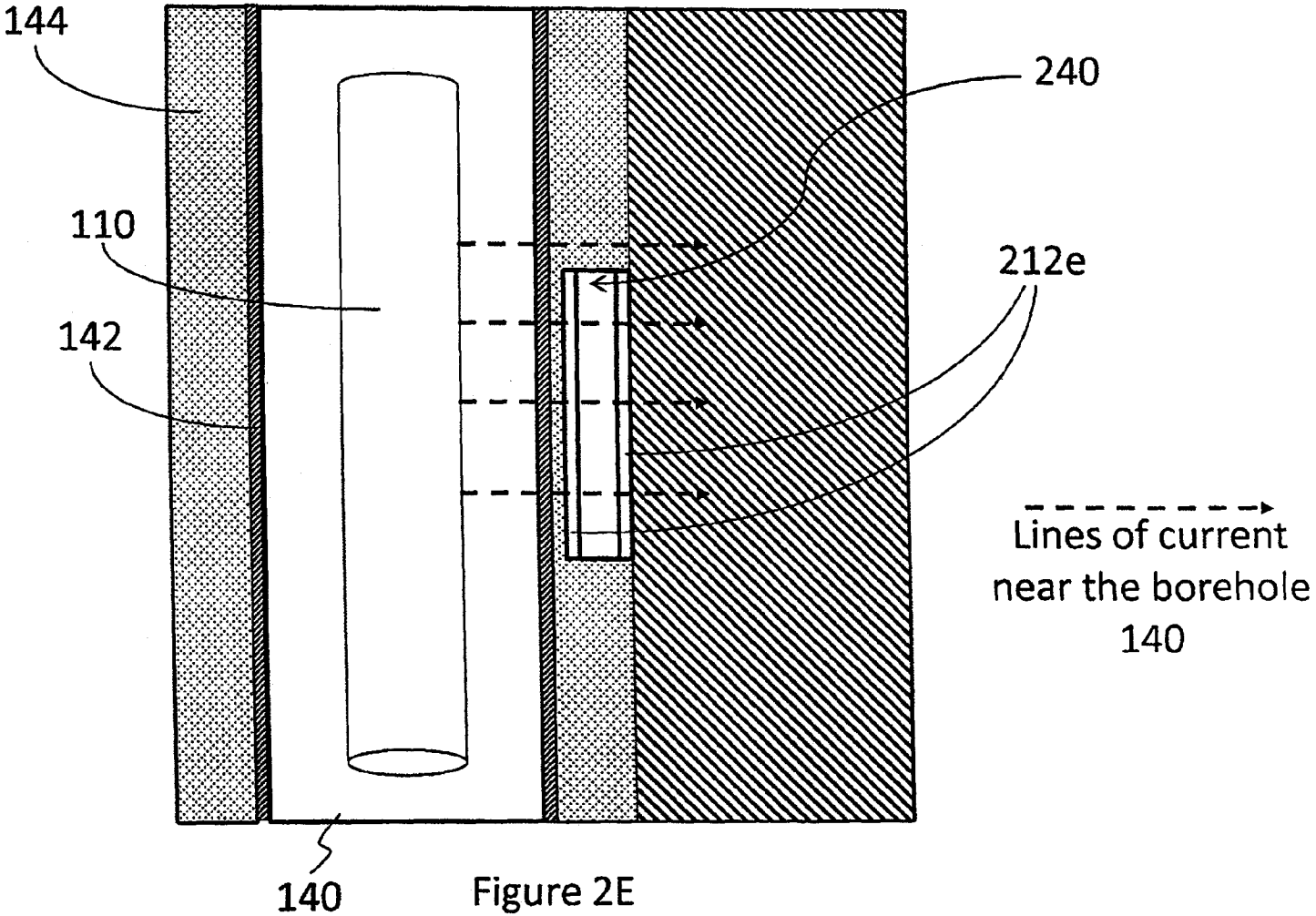
Figure 2F:
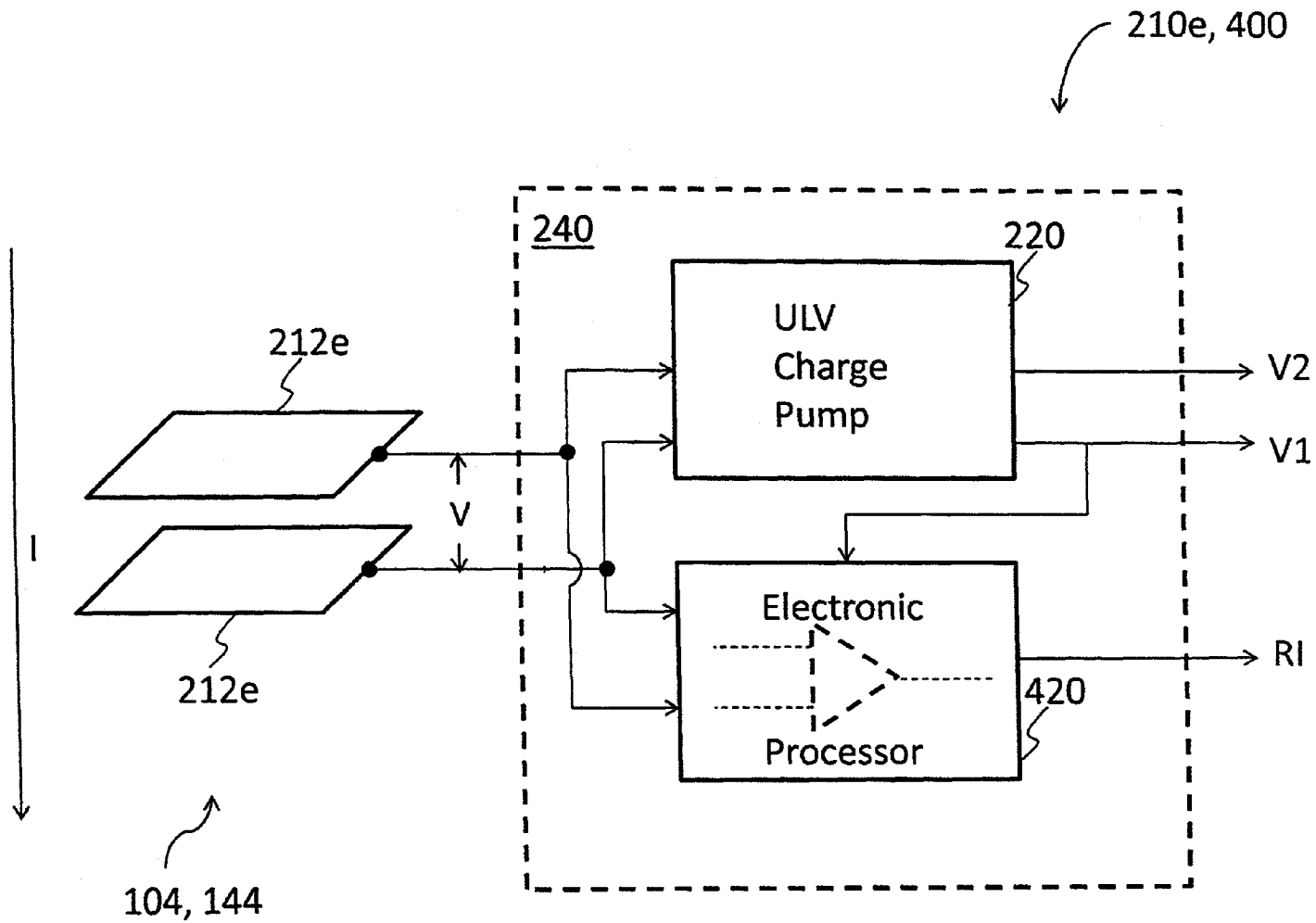

In FIGS. 2E and 2F, however, power harvesting circuit 210*e* while substantially in series with an electrical stimulation electrode 110 is not connected in series with common power bus 112 or a power conductor 202, but is associated with the electrode 110 per se so as to capture or harvest a portion of the current that is injected into the subterranean formation 104 by the electrode 110 of the electrical stimulation process. This is possible as a result of the high current densities of the currents that flow in the immediate vicinity of each electrode 110. Bore hole 140 is seen to have an inner steel liner 142 and the gap between inner steel liner 142 and the subterranean formation 104 is filled with cement 144. Bore hole 140 is filled with a bore hole filling fluid 146, e.g., a water based mud fluid, in which electrode 110 is suspended, e.g., by a common power bus conductor 122 or by a separate cable.

Power harvesting 210*e* is provided by a pair of power harvesting electrodes 212*e* that are spaced apart laterally, e.g., horizontally, in the gap between steel liner 142 and the subterranean formation 104. Power harvester 210 and electrodes 212*e* are typically placed in the gap prior to the gap being filled with cement 144. The high current flowing to electrode 110 through the cement fill 144 develops a voltage (potential difference) across the cement fill 144 at least a part of which voltage is applied between the spaced apart electrodes 212*e*. Thus, the power extraction provided by electrodes 212*e* may be employed in any of the previously described power harvesting circuits 210, e.g., in place of the potential voltage developed across any of diode D1, FET T1, FETs T1 and T2 and/or the primary winding of transformer X1, for applying input voltage to a power converter 220 and/or to a power supply 230 as described above.

Where the voltage V developed across power harvesting electrodes 212*e* is small, a low voltage charge pump 220 may be employed and where a more substantial voltage V is developed, any suitable DC-DC converter 220 and/or DC-AC inverter 220 may be employed, to provide various voltages for operating power harvesting 210, controls 300 and/or sensors and telemetry 400 of electrode system 100. Because the voltage V developed across spaced apart electrodes 212*e* is representative of the current flow I, electrodes 212*e* may be utilized as a sensor 410 and an electronic processor 420 may receive that voltage V to provide a representation RI of the current flow I or of the power (I×V) through material in which electrodes 212*e* are disposed, e.g., cement 144 and/or formation 104. Processor 420 may include an amplifier A and/or other processing, e.g., digital processing, as may be desired.

Where the spaced apart electrodes 212*e* are placed in the subterranean formation 104, the potential difference therebetween may be representative of the power being applied to the formation 104 and so may be a parameter that is measured and transmitted to the surface 102, e.g., by a telemetry system 400 as described herein. In this instance, spaced apart electrodes 212*e* may not only serve as power harvesting electrodes 212*e*, but may also serve as sensor electrodes for measuring a voltage representative of the injected current flow and/or of the power injected into the formation 104. In such case, electrodes 212*e* would typically be spaced apart by a predetermined distance so as to be calibrated or able to be calibrated as a current and/or power sensor. The sensor 400 and/or telemetry 400 circuits may be in the same container 240 that supports electrodes 212*e* and that contains power harvesting circuits 210*e*.

Power harvesting circuit 220*e* may be packaged in a container 240 that includes a power harvesting circuit 220, a power supply and distribution circuit 230, or both, and the pair of electrodes 212*e* may be on opposing exterior surfaces of container 240.

FIG. 3 includes FIGS. 3A-3D which are schematic diagrams of example embodiments of an electrical stimulation electrode current controlling arrangement 300 useful in the example electrically stimulated electrode system 100 of FIG. 1. Any current control arrangement 300 herein may be employed with any power harvesting arrangement 210 described herein and with any sensor and/or telemetry arrangement 400 described herein, as well as with other arrangements thereof. Sensors usable therewith are also described.

The electrical stimulation extraction process tends to operate optimally within a particular range of current densities injected into and flowing through formation 104. While it is not difficult to achieve injection at a current density within the optimal range when an electrical stimulation system employs only one electrode 110, it is substantially more difficult, if not impossible, in a system 100 employing plural electrodes 110 arrayed at various depths in a long bore hole 140. This is because the injected current density is affected by many parameters and factors that cannot be controlled, e.g., the resistivity of the formation 104 in the vicinity of each electrode 110, the conductivity of the bore hole fluid 146, the position of each electrode 110 in bore hole 140, the number of contact points with the formation 140, the condition of electrode 110, the temperature at each particular electrode 110 location, and the like. Even if all of the foregoing parameters were to be the same for each electrode 110 (an extremely unlikely condition), the current distribution among the different electrodes 110 would still be affected by the position of each electrode in the string of electrodes 110.

While the foregoing problem could be addressed by providing a separate adjustable power supply 120 and a separate power cable 122 for each electrode 110 so that the current of each could be individually adjusted from the surface 102, such solution is very costly and is likely impractical for strings having many electrodes 110. In addition, bore hole 140 may not be large enough for all of the individual cables 122 required to fit therein, e.g., because a cable intended to carry about 1000 amperes can be about 1.2 inch (about 1.25 cm) in diameter.

Figure 3A:
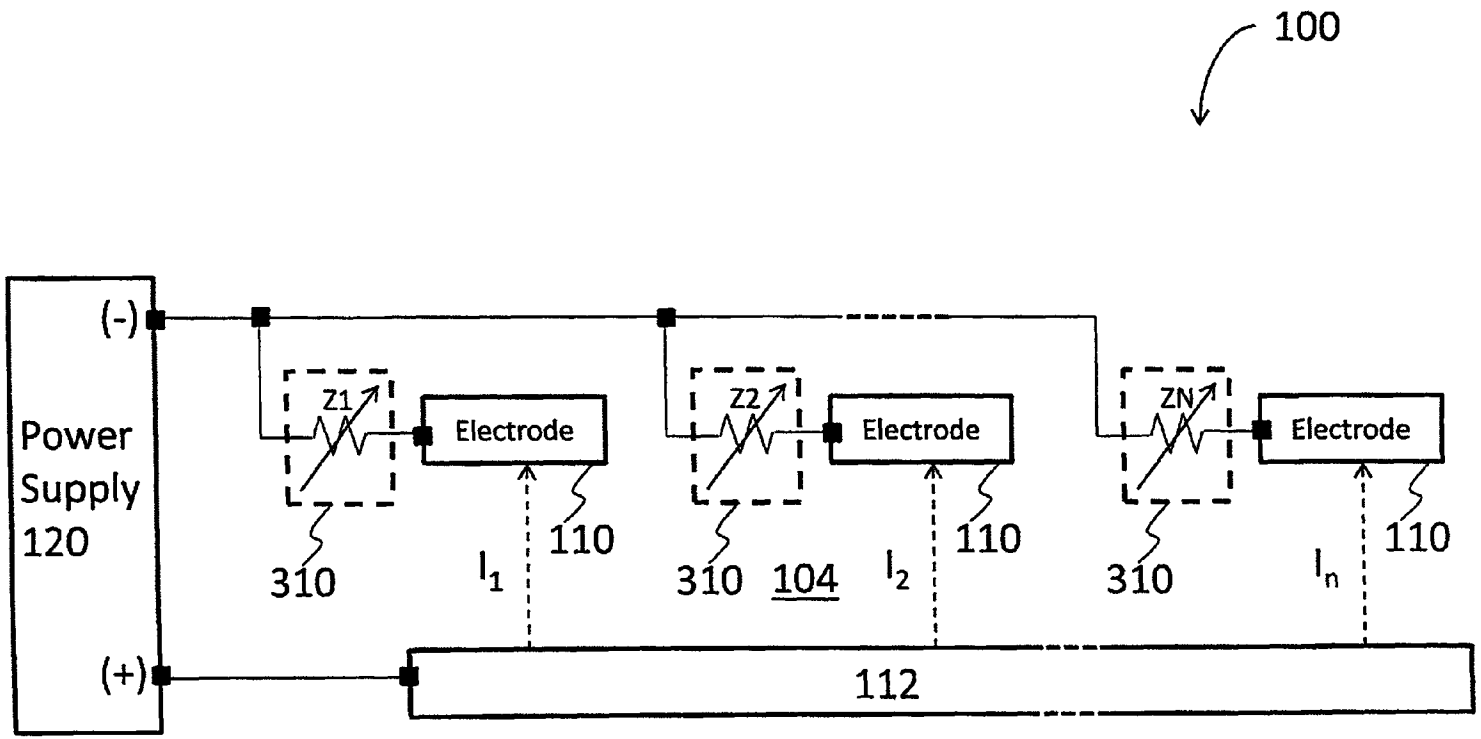
FIG. 3 includes FIGS. 3A-3D which are schematic diagrams of example embodiments of an electrode current controlling arrangement useful with the example electrode system of FIG. 1.

In the system 100 of FIG. 3A, an individual current controller 310 is associated with each one of plural electrodes 110 for independently controlling the current therethrough. In one example, each current controller 310 includes a respective controllable variable impedance Z1, Z2, . . . ZN that is connected in series with the electrode 110 with which it is associated for controlling the current $I_1$, $I_2$, . . . $I_N$ flowing therethrough, e.g., in conjunction with the particular parameters and conditions of the portion of subterranean formation 104 into which it injects current, and the voltage and current provided by the surface power supply 120.

While control of impedances Z1, Z2, . . . ZN may be accomplished in various different ways, including in some instances without communication between current controls 310 and the surface 102, in general it is preferable that there be communication between a control and telemetry system 130 at the surface 102 and the individual current controls 310 for monitoring the current flow and controlling the impedances Z1, Z2, . . . ZN thereof.

Figure 3B:
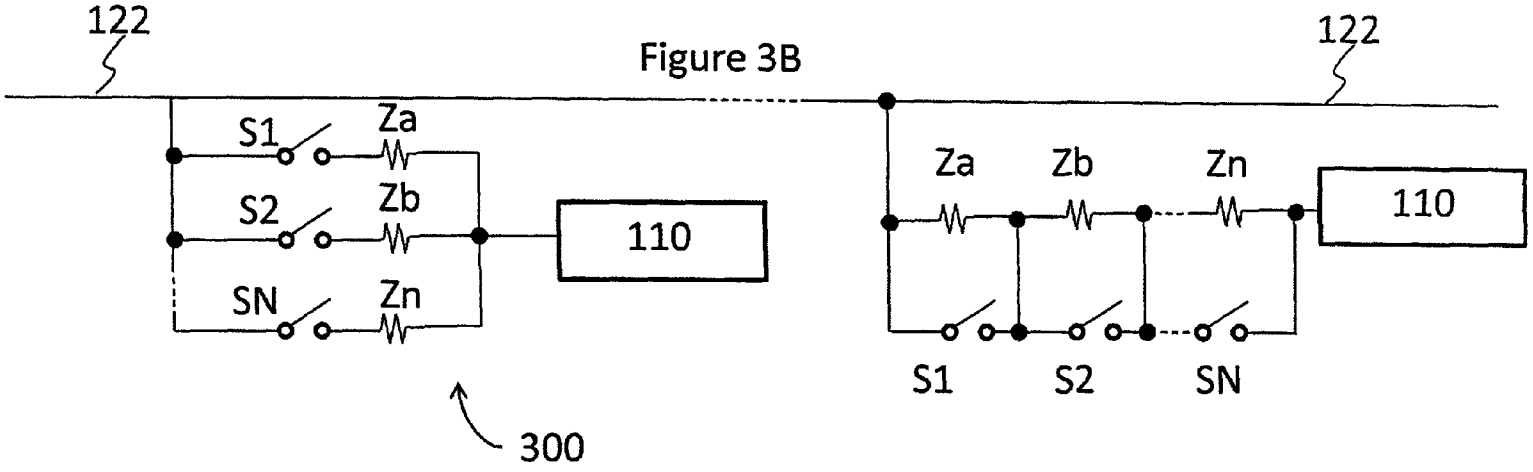

In FIG. 3B one control arrangement 300 not requiring such communication employs a number of switches each one being connected in series or parallel with a different one of separate impedance elements that combine to provide respective impedances Z1, Z2, . . . ZN that are series and/or parallel combinations of impedances Za, Zb, . . . Zn. Therein, associated with a first electrode 110, switch S1 is in series with impedance Za, switch S2 is in series with impedance Zb and so forth, and all of the series sets of a switch and an impedance are in parallel with each other. Alternatively, in the arrangement 300 associated with a second electrode 110, the impedances Za-Zn could be in series and switches S1-SN could close to bypass the impedance Za-Zn with which it is associated.

Switches S1-SN may be actuated by a local parameter or condition, e.g., temperature, pressure, or other local condition, in an arrangement that provides limited control of the current injected by electrodes 110. Such switches S1-Sn may be electro-mechanical switches, e.g., bi-metallic thermal switches and snap action pressure switches, or may be electronic switches operated, e.g., by electrical power provided by a power harvesting circuit 210 or another power source.

Alternatively, switches S1-SN and/or other control mechanisms may be actuated by an active control system, e.g., control and telemetry system 130 at the Earth's surface 102, responsive to one or more parameters or conditions, e.g., temperature, pressure, supplied current, injected current, injected current density, or other local condition, at or near to the electrode 110 with which it is associated. Such arrangement can provide more precise control of the current injected by electrodes 110 and can remove most if not all of the variability and uncertainty caused by conditions in the bore hole 140 not being known. Such switches S1-Sn and/or other control mechanisms may be electro-mechanical, e.g., electro-mechanical switches, solenoid actuated switches, relays, and other electro-mechanical switches, or may be electronic switches and circuits operated, e.g., by electrical power provided by a power harvesting and distribution circuit 210, or by another power source.

Figure 3C:
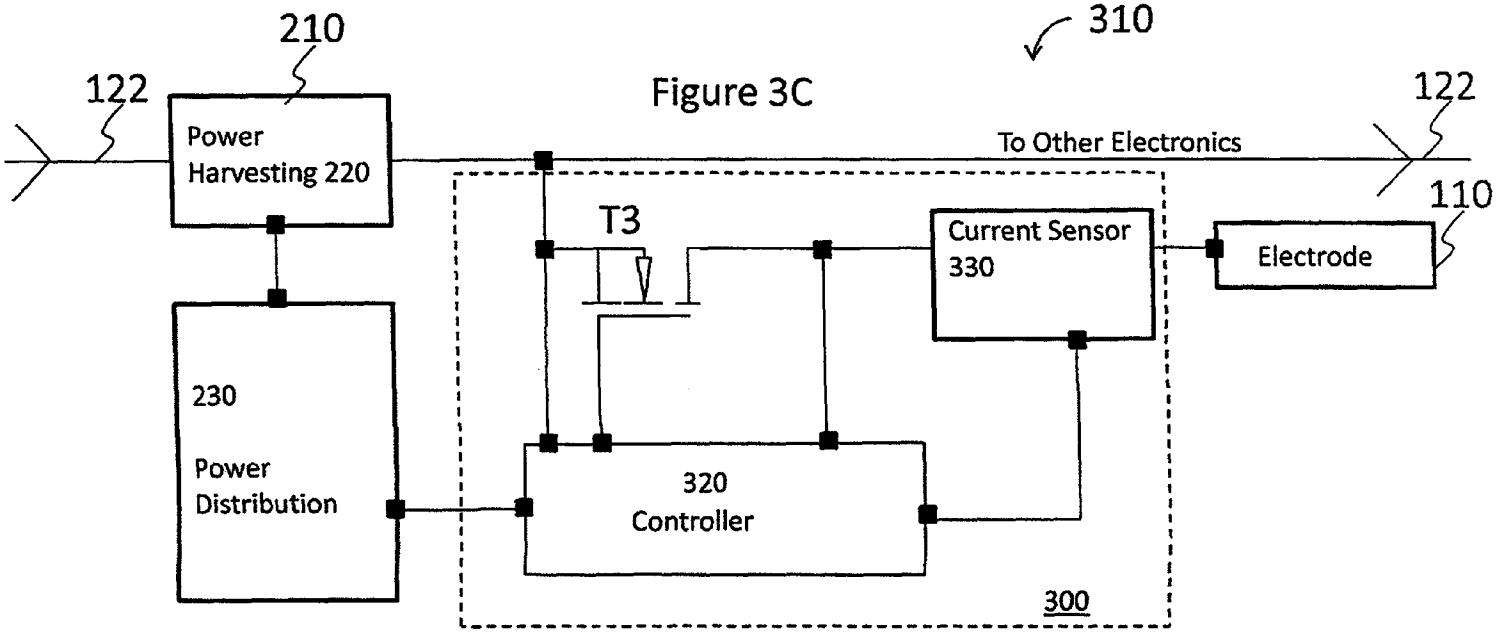

In FIG. 3C, current control 300 includes a controlled variable impedance provided, e.g., by a MOSFET transistor T3, connected in series with a current sensor 330 in conductor 202 all of which is connected in series between common power bus 122 and the electrode 110 whose current is to be controlled. Current sensor 330 provides a signal representative of the current flowing therethrough, i.e. the current flowing through electrode 110, to controller 320. Controller 320 provides a signal to the gate (control electrode) of FET T3 to control the conduction thereof, thereby to provide a controlled variable impedance in series with electrode 110 for controlling the current flow therethrough. Preferably, each electrode 110 has a separate current control 300 associated therewith.

Current sensor 330 may sense current in any suitable manner, and so may include, e.g., a small value resistance to generate a voltage representative of the current, or a Hall-effect transducer, magnetic amplifier, or another suitable current sensing circuit, that provides a signal representative of the current flowing through current sensor 330.

Controller 320 completes a feedback loop for controlling the current flowing through electrode by responding to the current flow indicated by current sensor 330 to control the variable impedance, e.g., the conductivity provided by FET T3, in series with electrode 110. Controller 320 may be, and preferably is, internally programmed to control FET T3 to provide a predetermined, e.g., fixed, default level of current to electrode 110.

In addition, controller 320 preferably is externally programmable to control FET T3 to provide a commanded level of current in response to commands received, e.g., from control and telemetry system 130, and also preferably is capable to communicate to control and telemetry system 130 at least an indication of the level of current flowing in electrode 110.

Electrical power for operating current sensor 330 and/or controller 320 is provided by power harvesting and distribution circuit 210 which includes a power harvesting circuit 220 and optionally a power distribution circuit 230 as described. Because FET T3 is operated with a continuously variable conductivity in this arrangement 300, substantial power can be dissipated and substantial heat generated in FET T3, e.g., the product of the voltage across FET T3 and the current through T3, e.g., the electrode 110 current, which power to be dissipated may reach levels of hundreds of watts.

For current control 300 to operate as a commandable and programmable current control as described, a communication path is needed to communicate data to controller 320 from control and telemetry system 130 and to communicate data from controller 320 to control and telemetry system 130. Typically the data communicated to controller 320 includes commands for setting a desired level of electrode current, a time for current flow, or both. Commands may also be employed to set modes of operation of controller 320, e.g., a fixed current mode, a programmed operating time and current profile, or a programmed current level as a function of another parameter, e.g., temperature, pressure, and the like, which may be measured by sensors included in electronic system 200. Example arrangements for providing such communication path, e.g., for commands, sensors and/or data telemetry, are described below.

Control and telemetry system 130 may command the current control 300 associated with each electrode 110 separately or together to operate in certain defined operating modes. Examples of these modes include, to establish and maintain a preset value of current through each electrode 110 or to establish and maintain a current through each electrode that is a preset percentage of the total current flowing in common power bus 122 at that electrode 110. In the latter instance, current sensor 330 of current control 300 includes two current sensors 330, one sensing the current through its electrode 110 and the other sensing the current flowing in power bus 122, which sensor may be located above or below the point at which conductor 202 connects to power bus 122.

In such arrangement, e.g., where three electrodes 110 are employed at three different depths in bore hole 140, current control 300 associated with the upper electrode 110, i.e. the one at the shallowest depth, could be programmed to direct one third (⅓) of the total current to that electrode 110 and two thirds (⅔) of the total current to continue on power bus 122 to the other two electrodes. Then, the current control 300 associated with the middle electrode 110 could be programmed to direct one half (½) of the total current to its associated electrode 110 and to direct the other half (½) of the current to continue on power bus 122 to the deepest electrode 110. The current control 300 of the deepest electrode 110 would be programmed to direct all of the current of power bus 122 to its associated electrode 110. The net result is that each electrode 110 would carry one third (⅓) of the total current provided by power supply 120. Of course, the current controls 300 are programmable to different proportions or percentages, or to particular current levels, as may be desired by the operator of electrode system 100.

Further, control and telemetry 130 and current controls 300 may be programmed to vary the current in an electrode 110 based upon a measured parameter or condition, e.g., electrode 110 temperature, fluid flow in the vicinity of an electrode 110, the viscosity of the fluid in the vicinity of an electrode 110, the chemical composition of the fluid in the vicinity of an electrode 110, or another measured parameter or condition. Such control may be implemented completely in electronic system 200 or may employ command and data telemetry between electronic system 200 and surface control and telemetry 130.

Further, control and telemetry 130 and current controls 300 may be programmed to vary the current in an electrode 110 based upon an operator determination, to a level determined from the surface system 120, 130, or determined by an automated, e.g., computer controlled, system. Such control requires command and data telemetry, e.g., two-way communication, between electronic system 200 and surface control and telemetry 130. An advantage of this arrangement is that current may be controlled to tend to optimize production form an individual well, e.g., an individual bore hole 140, or from a number of wells, e.g., a number of separate bore holes 140. Where there are a number of separate bore holes 140 in relatively close proximity, the separate bore holes 140 may each have an associated a return electrode 112 or one or more bore holes 140 may share one or more return electrodes 112. In system 100, power may be controlled and/or balanced for one well 140 or for a system of wells 140, e.g., so as to redistribute current from one well 140 to another and/or to control the total power consumption from the power utility source to be at or below a contracted level.

Still further, system 100 and controls 130, 300 thereof may be employed to control the magnitude or current in each electrode 110 and the distribution of the current among various electrodes 110, thereby to redistribute current in a manner that tends to optimize production, e.g., based upon down hole 140 measurements and production measurements. An example of this includes redistribution of current by reducing the current flowing in electrodes 110 that are located in lower productivity zones and redirecting that current by increasing the current flowing in electrodes 110 that are located in higher productivity zones. Moreover, such current redistribution is preferably automated by a computer processing "down hole" and production measurements including present conditions and historical data, e.g., of electrical current distribution, and may include one or more neural networks that can in effect "train" itself toward optimizing production.

In addition, current controls 300 may operate independently or may communicate, e.g., exchange sensor and/or telemetry data, so as to determine the current levels to be provided to their associated electrodes 110, as may be advantageous, e.g., where communication with surface control and telemetry 130 is of poor quality, is interrupted or has failed. The preset programs executed by current controls 300 may include, e.g., setting preset fixed current levels and/or for time sequencing the electrode 110 currents, or a combination thereof, thereby to effect an autonomous control of current distribution.

Figure 3D:
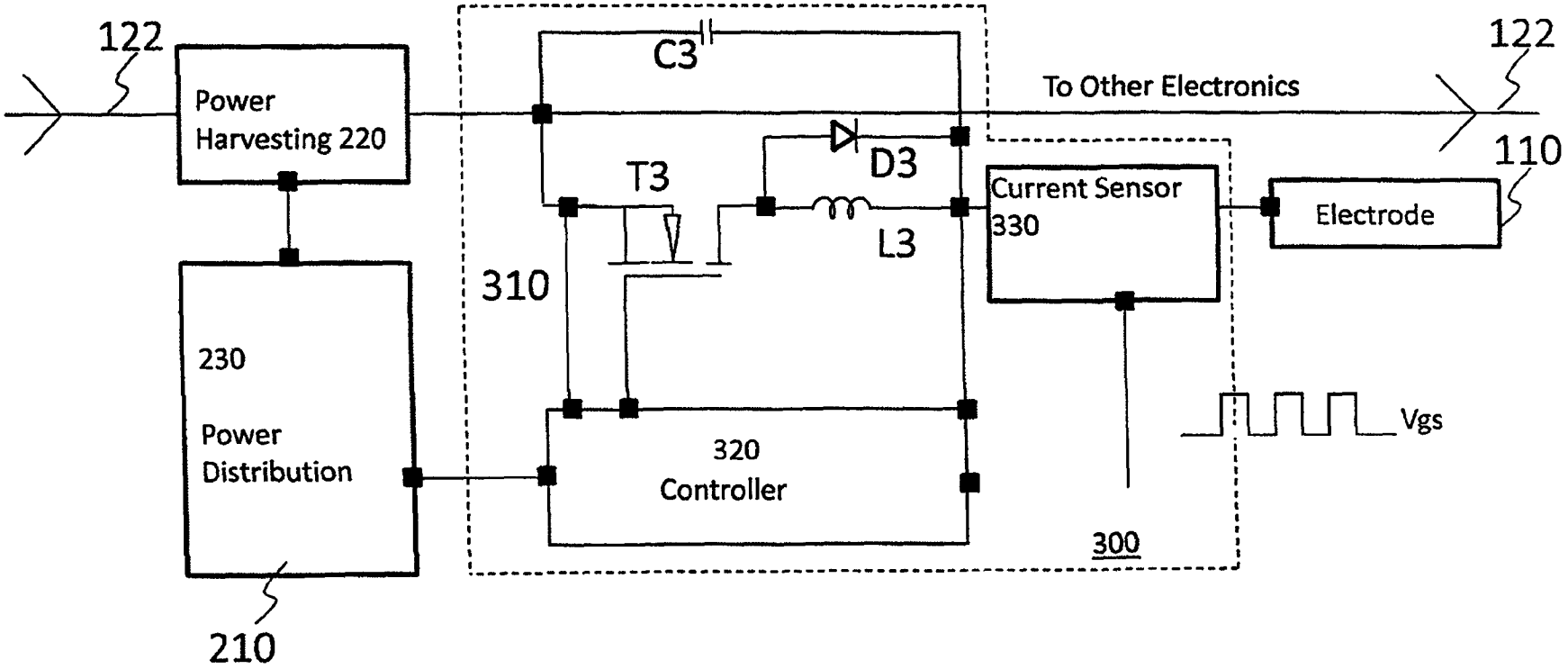

In current control 300 of FIG. 3D, power dissipation in the variable impedance element, e.g., an impedance Z or FET T3, is reduced by employing a power switching element, e.g., FET T3, in an ON-OFF switching mode. Instead of controller 320 applying a continuously variable analog control signal to the gate (control electrode) of FET T3, controller 300 generates a waveform signal Vgs that alternately turns transistor T3 On and OFF at a relatively high frequency, e.g., a frequency in a range between about 10 KHz and 500 KHz. Gate control signal waveform Vgs is generated with a variable duty cycle (ON to OFF time ratio) so as to control the current applied to electrode 110.

While FET T3 is switching ON and OFF, inductor L3 resists changes in current magnitude and so tends to limit and smooth the current drawn from common power bus 122. Diode D3 limits the voltage appearing across FET T3 and protect T3 against voltage transients, while a relatively large capacitor C3 tends to smooth the current ripple injected into power bus 122 and to smooth the voltage between power bus 122 and electrode 110, thereby to supply current to electrode 110 during the intervals when FET T3 is OFF. The inductance provided by inductor L3 will be selected according to the selected switching frequency and the maximum current value, as is known to those of ordinary skill in the art.

Where it is acceptable to inject a higher ripple current into power bus 122, inductor L3 and capacitor C3 may be reduced in value. At the limit, where it is acceptable to employ the inherent inductance of power bus 122 and to inject a much greater ripple current into common power bus 122, current control 300 may be simplified, e.g., by eliminating inductor L3 and capacitor C3. Implementations of various switching mode power converters are known and integrated circuit controllers therefor are commercially available, and so need not be further described herein.

Figure 4A:
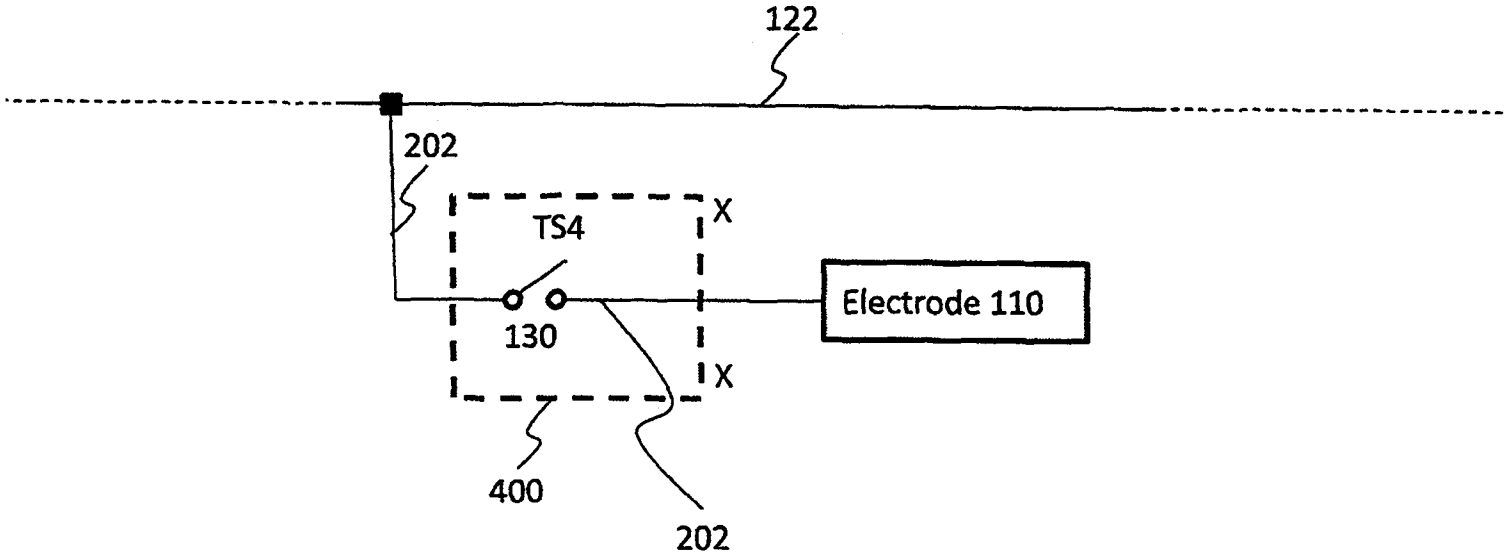
FIG. 4 includes FIGS. 4A-4C which are schematic diagrams of example embodiments of an electrode sensor arrangement useful with the example electrode system of FIG. 1.
Figure 4B:
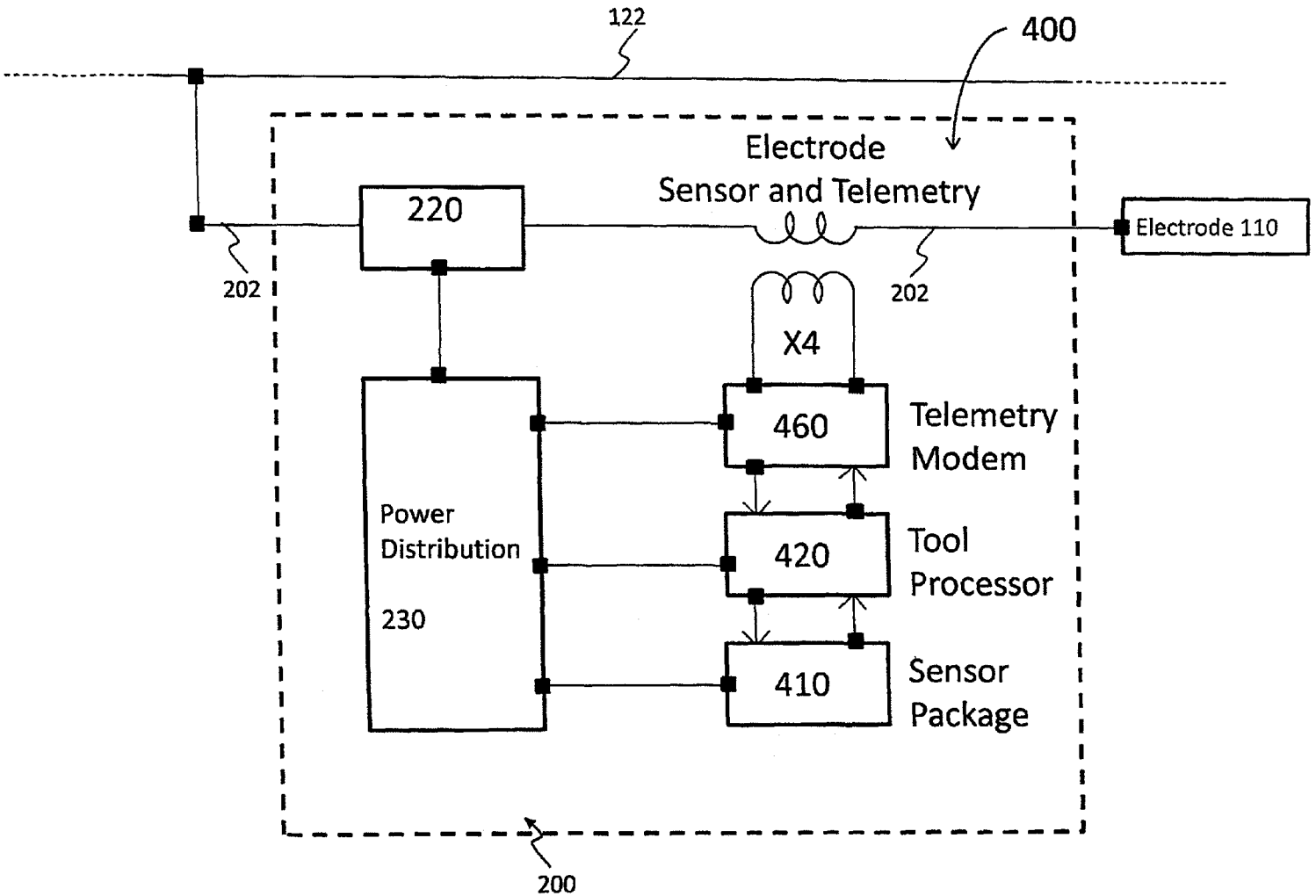
Figure 4C:
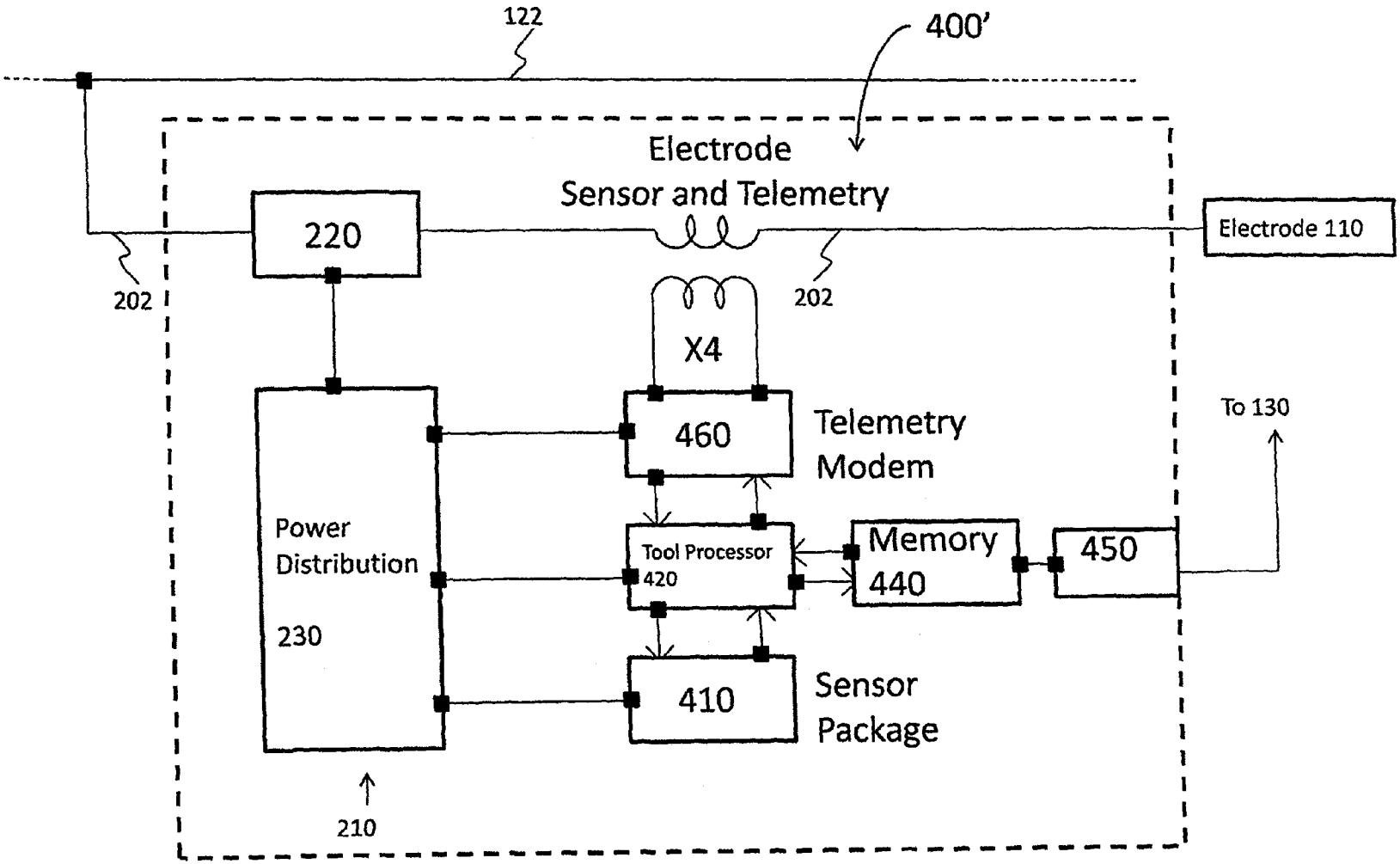

FIG. 4 includes FIGS. 4A-4C which are schematic diagrams of example embodiments of an electrical stimulation electrode sensor arrangement 400 useful with the example electrically stimulated electrode system 100 of FIG. 1. Any sensor arrangement 400 herein may be employed with any power harvesting arrangement 210 described herein, with any current control arrangement 300 described herein, and with any telemetry arrangement 400 described herein, as well as with other arrangements thereof.

Control and preferably optimization of the electrical stimulation process can be facilitated by knowing certain parameters relating to the electrode 110 and to its environment, including the bore hole fluid 146 and the subterranean formation 104. Examples thereof may include, e.g., electrode temperature, bore hole fluid temperature, bore hole fluid pressure, bore hole fluid pH, bore hole fluid composition, bore hole fluid flow, current injected by each electrode, resistivity of the formation in the vicinity of the bore hole, and/or porosity or change of porosity of the formation in the vicinity of the bore hole (measured by sensing acoustic transmission rate wherein acoustic slowness can be indicative of cementation and/or scaling).

The foregoing information and/or data may be utilized for improving the efficiency of, and preferably for tending to optimize, operation of the electrical stimulation process and control of well operation, and by providing information and/or data for controlling operation and/or configuration of various equipment associated with the well. Examples thereof may include controlling the level of electric current for avoiding overheating of the electrode, controlling various pumps and valves to increase production, e.g., of oil or an oil/water cut, controlling auxiliary treatments such as acid treatment, anti-scaling, asphaltene/wax removal, sand removal and/or fracturing, adjusting additives such as viscosity reducing agents and/or diluents for facilitating flow, replacement and/or positioning of electrodes, and/or replacement of the liner, gravel pack or other sand control measures.

The foregoing is preferably performed during operation of electrode system 100 and does not require that the electrical stimulation provided by system 100 be discontinued, and so avoids the limited information available from and costly nature of conventional bore hole and production logging tools. While coupling permanent or auxiliary sensors via a fiber optic cable can provide relatively continuous information, their installation and operation is seen as imposing significant costs.

In FIG. 4A, sensor 400 includes a thermally (temperature) sensitive switch TS4, e.g., a bi-metallic type switch, connected between common power bus 122 and an electrode 110 for opening a switch contact TS4 when the electrode temperature exceeds a predetermined temperature, e.g., a maximum safe temperature. Thus, because switch S4 is thermally coupled to electrode 110, when the temperature of electrode 110 increases to the predetermined temperature, switch TS4 disconnects electrode 110 thereby to protect electrode 110 and the power cable 122, 202 connected thereto from further temperature increase, e.g., to an unsafe level. When the temperature falls below the predetermined temperature, switch TS4 closes to reconnect electrode 110 to power bus 122, to resume injecting current into formation 104. In a preferred thermally sensitive switch TS4, the predetermined temperature at which the contacts of switch TS4 open may be slightly greater than the temperature at which the contacts thereof close so as to provide hysteresis.

In FIG. 4B, electronic system 200 includes power harvesting and distribution 210 and electrode sensor and telemetry 400. Power harvesting and distribution 210 comprises, e.g., power harvesting device 220 and power conditioning and distribution 230, as described herein, Sensor and telemetry 400 comprises, e.g., sensor package 410, tool processor 420 and telemetry modem 460, all interconnected for communicating information and/or data therebetween, and each connected to power distribution 230 for receiving electrical power therefrom. While a current control 300 may be included, it is not shown for simplicity.

Sensor package 410 typically includes one or more sensors, e.g., temperature sensors, pressure sensors, chemical sensors and the like, that sense the condition of electrode 110 and/or the environment in the vicinity thereof and provide information and/or data representative thereof to processor 420, e.g., via a data port, as indicated by the two arrows pointing in opposite directions. The sensors of sensor package 410 may operate continuously and the data therefrom may be sampled essentially continuously and transmitted to the surface essentially in "real time," e.g., substantially contemporaneously with when the data is measured (acquired) in view of the rate at which the measured parameter may change.

Parameters that may change relatively quickly, e.g., in seconds, such as pressure or electrode current, might be measured (sampled) every second or a low number of times per second, or even every few seconds, whereas parameters that change only relatively slowly, e.g., in minutes or hours, such as temperature, might be measured (sampled) every minute or hour or a low number of times per minute or hour. The timing and sequencing of when data from sensors 410 are acquired may be controlled by processor 420 or by a timing control of sensor package 410 that determines the data sampling times or that operates the sensors 410 for short intervals (sampled) on a regular or periodic basis.

Processor 420 acquires and processes the data, applies appropriate corrections thereto, e.g., predetermined corrections based upon calibrations of the sensors, known sensitivity of any sensor to another parameter, e.g., for a pressure sensor that is sensitive to temperature, and prioritizes and formats the data into a predetermined format for transmission, e.g., to the surface control and telemetry 130.

Data processed by processor 420 may be provided, e.g., via a data port, to telemetry modem 460 which in turn transmits the data to surface control and telemetry 130 via transformer X4 and conductors 202, 122. By way of example, modem 460 may modulate the data, e.g., as a data stream, data packets or other formatting, onto a carrier signal which modulated carrier signal is applied via transformer X4 to be superimposed onto power bus 122, e.g., on the DC electrode current (and current ripple) flowing therein.

It is noted that data modulated carrier signals from plural sensor and telemetry systems 400 may be multiplexed on common power bus 122, e.g., using multiplexing such as by different carrier frequencies, transmission time sequencing, TDMA, FDMA, CDMA, spread spectrum, frequency hopping, and the like. It is further noted that data from different electrodes 110 may be compared, e.g., by control and telemetry 130, for analyzing and/or determining conditions in bore hole 140 not associated with a particular electrode, e.g., a difference in the bore hole fluid pressure measured at different electrodes 110 in the same hole 140 may be indicative of a flow restriction and/or blockage therebetween, would be useful to operators for controlling operation of the well and/or the electrode system 100, e.g., in understanding a condition and/or in deciding whether or not or how to intervene to correct or mitigate a condition.

In FIG. 4C, similarly to FIG. 4B, electronic system 200 includes power harvesting and distribution 210 and electrode sensor and telemetry 400'. Power harvesting and distribution 210 comprises, e.g., power harvesting device 220 and power conditioning and distribution 230, as described herein, Sensor and telemetry 400' comprises, e.g., sensor package 410, tool processor 420 and telemetry modem 460, all interconnected for communicating information and/or data therebetween, and each connected to power distribution 230 for receiving electrical power therefrom. While a current control 300 may be included, it is not shown for simplicity.

Sensor and telemetry 400' differs from sensor and telemetry 400 in that it further includes a memory 440 for storing the all or part of the data provided by sensors 420 and processed by processor 420. Data may be stored in memory 440 for later use by processor 420 and/or for later transmission to surface control and telemetry 130, and the data may include accumulating one or more sets of data from the set of sensors included in sensor package 410.

Data processed by processor 420, including but not limited to data stored in memory 440, may be provided, e.g., via a data port, to telemetry modem 460 which in turn transmits the data to surface control and telemetry 130 via transformer X4 and conductors 202, 122 as described. Alternatively, memory 440 may be coupled to a data port 450, e.g., a serial port, Ethernet, USB, wireless or other communication link, that communicates with surface control and telemetry 130, e.g., via an electrical cable or optical fiber. Where only historical data, i.e. non-real time data, is to be transmitted, memory 440 may accumulate data until it receives a command to transmit data, e.g., a read command from control and telemetry 130.

Memory 440 preferably includes a non-volatile memory so that data stored therein will not be lost in the event that electrical power thereto is interrupted. In particular, memory 440 may be an electronic memory, e.g., a static random access memory (RAM), either external to or internal to processor 420, or a magnetic or optical recording memory, however, memory 440 may also be a non-electronic memory.

Additionally and/or alternatively, memory 440 may include a non-electronic memory device, e.g., an electrochemical cell that can record an accumulated charge proportional to the signal applied thereto which is representative of a parameter measured by a sensor 410. Memory 440 may also include phase change devices, e.g., materials that change color or another characteristic permanently in response to a parameter, e.g., to temperature reaching a predetermined level, as may be useful for recording whether a critical temperature has been reached or exceeded. Such devices tend to function as both sensor 410 of a parameter and as a memory 440 of the parameter sensed. Similarly, shape memory metal alloys that change shape at a predetermined temperature or pressure may also be employed, and may serve as sensor 410 of a parameter and as memory 440 of the parameter sensed.

Such non-electronic sensors and memory devices 410, 440 may offer the advantage of preserving data that can be determined by examining the devices 410, 440 on the surface, e.g., as when electrodes 110 are removed or recovered from bore hole 140 for maintenance, for inspection, or for forensic examination and analysis after a failure has occurred.

It is noted that the foregoing arrangements 400 not only provide for substantially continuous sensing and monitoring or electrodes 110 and/or of their environment, because they may be included in a the electrodes 110 and/or may be contained in an enclosure installed on common power bus 122, they do not require that the electrical stimulation be discontinued and do not require an installation separate from the installation of electrodes 110. Thus, the advantages of the foregoing arrangements may include: installation of the electrode 110 and sensors 400 in a single operation, employing the power bus 122 to support sensors 400, employing power buss 122 for telemetry of information and/or data between electronic system 200 and the surface, e.g., control and telemetry 130, and/or utilizing the information and/or data from sensors 400 for controlling the current in each electrode 110.

Figure 5:
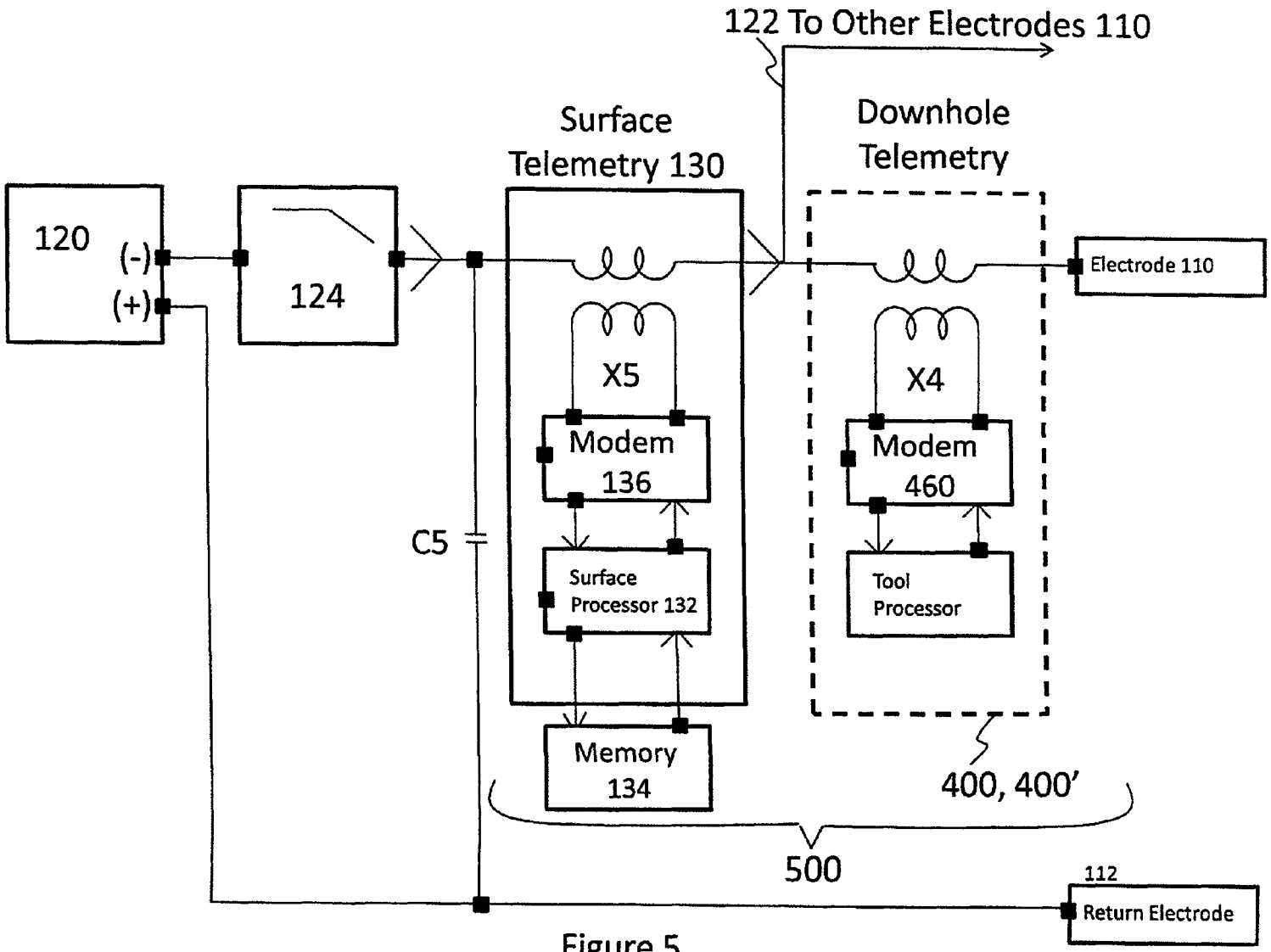
FIG. 5 is a schematic diagram of an example embodiment of an electrode system telemetry arrangement useful with the example electrode system of FIG. 1.

FIG. 5 is a schematic diagram of an example embodiment of an electrically stimulated electrode system telemetry system arrangement 500 useful with the example electrically stimulated electrode system 100 of FIG. 1. Telemetry system 500 comprises surface control and telemetry 130 and one or more electrode sensor and telemetry 400, 400' devices. Any telemetry arrangement 500 herein may be employed with any power harvesting arrangement 210 described herein, with any current control arrangement 300 described herein, and with any sensor and telemetry arrangement 400, 400' described herein, as well as with other arrangements thereof.

Telemetry system 500 is preferably provides bilateral communication between surface control and telemetry and one or more electrode sensor and telemetry 400, 400' and the one or more electrode sensor and telemetry 400, 400' devices may also be configured to communicate with each other via telemetry system 500. Because preferred the sensor and telemetry 400, 400' embodiment of each electronic system 200 includes a processor 440, the As shown, communication between surface control and telemetry 130 and one or more electrode sensor and telemetry 400, 400' is via common power bus 122, however, a separate electrical or optical cable or wireless communication link may be provided, and communication may also be provided via modulated acoustic vibrations induced in the bore hole liner 142 or in a production pipe or fluid column in the bore hole 140, or electro-magnetically via low frequency electromagnetic pulses generated to be carried through subterranean formation 104 and detected by sensing electro-magnetic field changes at the receiver, e.g., at electronics system 200 near electrode 110.

Such communication may include communicating commands and data from surface control and telemetry 130 to one or more electrode sensor and telemetry 400, 400', communicating data from one or more electrode sensor and telemetry 400, 400' to surface control and telemetry 130, communicating information and data between the one or more electrode sensor and telemetry 400, 400' devices, or all of the foregoing.

Because system 100 employs a direct electrical connection to carry electrical current from the electrodes 110 to the surface 102, an electrical communication link utilizing such connection is facilitated. Electrical communication at baseband frequencies may be provided using the electrode 110 current, e.g., by varying (pulsing) the DC electrode 110 current provided by source 120 for transmitting data to electrodes 110, and by varying (e.g., pulsing) the controllable impedance of current control 300 for generating current changes for communicating data to the surface 102 via current variations that can be detected at surface control and telemetry 130.

Alternatively, and preferably, a carrier modulated with the data can be superimposed upon the current flowing in common power bus 122 for communicating data between (to and from) surface control and telemetry 130 and sensor and telemetry 400 of electronics systems 200 at the electrodes 110. Typically, the frequency of the carrier, preferably a sinusoidal carrier signal, may be in the range of about 1 KHz to 1 MHz, and carriers at two or more different carrier frequencies may be employed for providing simultaneous communication over different channels, e.g., full duplex communication including communication in both directions simultaneously, and for providing better noise immunity and higher bandwidth. Specific carrier frequencies may be selected so as to be in frequency bands that are relatively low in noise and interfering signals, including current noise generated by the flow of current through subterranean formation 104, and at which the attenuation caused by the long length of power conductors 112, 122 is acceptable for reliable communication.

In the example embodiment of FIG. 5, down hole telemetry 400, 400' communicates with surface telemetry 130 via common power bus 122 that carries current to electrodes 110, and surface telemetry 130 communicates with down hole telemetry 400, 400' via common power bus 122. Each telemetry 130, 400, 400' includes a modem which comprises a modulator and a demodulator (e.g., MODulator+DEModulator="MODEM"), wherein the modulator modulates the command, data and other information to be communicated onto a carrier signal and transmits the modulated carrier signal and the demodulator receives and demodulates command, data and other information modulated on a received modulated carrier signal. In each modem 136, 460, the modulator and demodulator preferably operate at different carrier signal frequencies.

Modem 136 injects (transmits) commands, data and information to be transmitted by surface control and telemetry 130 onto power bus 122 via transformer X5 and receives data and information to be received thereby via transformer X5. Likewise, modems 460 inject (transmit) data and information to be transmitted by telemetry 400, 400' onto power bus 122 via transformer X4 and receive commands, data and information to be received thereby via transformer X4. Specific implementations of modulators and demodulators are known and suitable modulator/demodulator circuits (modems) are available commercially, e.g., a type CMX7163 QAM modem available from CML Microcircuits located in Langford, England.

Typically, the predominant information transmitted by surface telemetry 130 includes commands and data values for configuring and operating respective electrodes 110 and the electronic systems 200 associated therewith, and the predominant information transmitted by each electrode 110 telemetry 400, 400' includes data representative of the configuration and operation of the electrode 110 with which it is associated and the electrode environment as primarily provided by sensors 410.

Surface processor 132 is a processor 132 that monitors operation of system 100 and generates commands for controlling operation of electronic systems 200 thereof. Processor 132 monitors operation of system 100 based upon data received via telemetry modem 136 from the telemetry 400, 400' electronic systems 200 of the various electrodes 110 via modems 460 thereof. Processor 132 generates commands and other information to be transmitted to the electronic systems 200 of the various electrodes 110 based upon data and other information received from electronic systems 200, from data and other information received from monitoring devices associated with the well and its production, e.g., at the surface 102, and/or from operator generated inputs. Processor 132 communicates with memory 134 for storing data and information therein and for reading data and information stored therein, including data and information received from electronic systems 200 of the various electrodes 110 and instructions for controlling the operation of processor 132, e.g., computer program instructions.

The current path for data and information transmitted by modems 136, 460 includes power bus 122, electrode 110, electrically stimulated formation 104, return electrode 112, and capacitor C5. Because power supply 120 is typically a source of electrical ripple, noise and interfering signals which may be at frequencies or contain components at frequencies at which data is desired to be communicated, low pass filter 124 is preferably interposed between the output of power supply 120 and the remainder of system 100, so as to substantially reduce such ripple, noise and interference so as to render communication more reliable. Because filter 124 exhibits high impedance at the carrier frequencies at which communication is desired, capacitor C5 is connected between the output of filter 124 and the return conductor 126 of return electrode 112 to provide a low impedance path for communication signals at the carrier frequencies.

In a typical embodiment, electrodes may be made of any suitable conductive material, such as metals, graphite, conductive composites and/or ceramics. Electrodes may be surface treated to improve their thermal and corrosion resistance, e.g., a thin layer of conductive oxide can be deposited on the surfaces thereof. Power carrying lines are typically made of copper or aluminum which have low electrical resistivity, however, any electrically conductive medium may be employed. In some implementations electrical power may be conducted to the down hole electrodes by the well casing and/or production tubing, which are usually made of steel. While steel is a relatively poor electrical conductor, this method of connection becomes feasible where the well casing and/or production tubing have a sufficiently large cross-sectional area to serve as a power transmission line.

The sensors, actuators and electronic circuitry may be housed in enclosures and/or containers made of any suitable high strength material that is capable of withstanding the pressure, temperature and potentially corrosive environments found in a well bore hole. Such materials include many metals, e.g., stainless steel, high strength nickel alloys (such as Inconel 718), titanium, and/or beryllium-copper alloys. Where electrical isolation is needed, such as for connectors and feed through connections, high performance insulating thermoplastics, e.g., polyether ether ketone (PEEK) or ceramics are suitable for providing insulator structures. Many commercially available sensors of various physical conditions and parameters are suitable for use in a down hole sensor system, e.g., pressure transducer part number 211-37-520 and other pressure and temperature sensors available from Paine Electronics, LLC, located in East Wenatchee, Wash.

An electrically stimulated electrode system 100 may comprise: at least one injection electrode 110 for being disposed in a subterranean formation 104; a return electrode 112 coupled to the subterranean formation 104; a power supply 120 connected to the at least one injection electrode 110 and to the return electrode 112, the power supply 120 for applying electrical potential between the at least one injection electrode 110 and the return electrode 112 for causing electrical current to flow through the subterranean formation 104; and at least one electronic system 200 associated with the at least one injection electrode 110, the at least one electronic system 200 may include: a power harvester 210 for extracting electrical power from the current flowing in the at least one injection electrode 110 for powering the electronic system 200; or a current control 300 for controlling the current flowing through the at least one injection electrode 110; or at least one sensor 400 providing a representation of a parameter of the at least one injection electrode 110 or the subterranean formation 104 or both; or a telemetry 400 for receiving a representation of a parameter relating to the at least one injection electrode 110 or the subterranean formation 104 or both; or a combination of any two or more of the power harvester 210, the current control 300, the at least one sensor 400 and the telemetry 400. The power harvester may include: an electronic element D1, D2, D3, T1, T2, T3 or a transformer X1 or both through which the current flowing through the at least one injection electrode 110 flows; or an ultra-low voltage charge pump circuit 220; or an electronic element D1, D2, D3, T1, T2, T3 or a transformer X1 or both through which the current flowing through the at least one injection electrode 110 flows and an ultra-low voltage charge pump circuit 220. The electronic element may include a diode D1, D2, D3, a transistor T1, T2, T3 and/or a resistance 202, Z. The current control 300 may include: at least one controllable electronic element 310 through which the current flowing in the at least one injection electrode 110 passes; and a control circuit 320 coupled to the at least one controllable electronic element 310 for controlling the current flowing in the at least one injection electrode 110. The at least one controllable electronic element 310 may include a transistor T1-T3 or may include a thermally actuatable switch S1-SN, TS4 and the control circuit 320 may include a bimetallic element TS4. The control circuit 320 may be responsive to the at least one sensor 400 or to the telemetry 400 or to both for controlling the level of the current flowing in the at least one injection electrode 110. The at least one sensor 400 may include a sensor of electrode temperature, of bore hole fluid temperature, of bore hole fluid pressure, of bore hole fluid pH, of bore hole fluid composition, of bore hole fluid flow, of current injected by each electrode, of resistivity of the formation in the vicinity of the bore hole, and/or of porosity or change of porosity of the formation in the vicinity of the bore hole, of acoustic transmission rate, or of any combination of any two or more of the foregoing. The at least one sensor 400 may include at least one sensor device 410 and a processor 420 for processing data produced by the at least one sensor device 410. The telemetry 400 may include: a surface telemetry 130 coupled to an electrical conductor 122 carrying current between the power supply 120 and the at least one electrode 110; and at least one electrode telemetry 400 associated with the at least on injection electrode 110, wherein the at least one telemetry 400 is coupled to the conductor 122; wherein the surface telemetry 130 and the at least one electrode telemetry 400 couple data to the conductor 122 and receive data from the conductor 122 for communicating data between the surface telemetry 130 and the at least one electrode telemetry 400. The current control 300 for controlling the current flowing through the at least one injection electrode 110 may be commandable or may be programmable or may be commandable and programmable; and the electrically stimulated electrode system 100 may further comprise: a control system 130, 200 for commanding or programming or commanding and programming each current control 300 to set the current flowing in the injection electrode 110 associated therewith to a given current level, to flow at a given time, or to flow at a given level at a given time, whereby the current flowing in each injection electrode 110 may be independently controlled and/or sequenced in time. The power harvester 210, 220, 240 may comprise: a pair of spaced apart electrodes 212*e* for being disposed in an orientation wherein current flows in a direction generally aligned with the direction in which the pair of spaced apart electrodes 212*e* are spaced apart, whereby a voltage produced across the pair of spaced apart electrodes 212*e* is representative of the current flowing; and a power conversion device 220, 240 having an input connected to the pair of spaced apart electrodes 212*e* for receiving the voltage produced thereacross for receiving electrical power therefrom, and having an output V1, V2 at which at least a portion of the electrical power received at the input thereof is provided. The subterranean formation 104 may include an oil bearing formation, a chemical bearing formation, a water bearing formation, a contaminated water bearing formation, a rock formation, a shale formation, a sandstone formation, a carbonate formation, a soil formation, a clay formation, and formations including a combination thereof.

A sensor device 410 for sensing current flow through a material 104, 144 and/or for extracting power therefrom may comprise: a pair of spaced apart electrodes 210*e* for being disposed in the material 104, 144 in an orientation wherein current flows in the material 104, 144 in a direction generally aligned with the direction in which the pair of spaced apart electrodes 212*e* are spaced apart, whereby a voltage produced across the pair of spaced apart electrodes 212*e* is representative of the current flowing through the material 104, 144; a power conversion device 220 having an input connected to the pair of spaced apart electrodes 212*e* for receiving the voltage V produced thereacross for receiving electrical power therefrom, and having an output V1, V2 at which at least a portion of the electrical power received at the input thereof is provided; and an electronic processor 420 responsive to the voltage V produced across the pair of spaced apart electrodes 212*e* for providing a representation of the current flowing in the material 104, 144. The material 104, 144 may include a subterranean formation 104 or a cement liner 144 or both. The power conversion device 220 includes an ultra-low voltage charge pump circuit.

An electrically stimulated electrode system 100 may comprise: a plurality of injection electrodes 110 for being disposed in a subterranean formation 104; a return electrode 112 coupled to the subterranean formation 104; a power supply 120 connected to the plurality of injection electrodes 110 and to the return electrode 112, the power supply 120 for applying electrical potential between the plurality of injection electrodes 110 and the return electrode f112 or causing electrical current to flow through the subterranean formation 104; an electronic system 200 associated with each of the injection electrodes 110, the electronic system 200 including: a power harvester 210 for extracting electrical power from the current flowing in the injection electrode 110 associated therewith for powering the electronic system 200; and a current control 300 for controlling the current flowing through the injection electrode 110 associated therewith, wherein the current control 300 is commandable or is programmable or is commandable and programmable; and a control system 130, 200 for commanding or programming or commanding and programming each current control 300 to set the current flowing in the injection electrode 110 associated therewith to a given current level, to flow at a given time, or to flow at a given level at a given time, whereby the current flowing in each of the injection electrodes 110 may be independently controlled and/or sequenced in time. The power harvester 210, 220 may include: an electronic element D1, D2, D3, T1 or a transformer X1 through which the current flowing through the injection electrode 110 associated therewith flows; or an ultra-low voltage charge pump circuit 220; or an electronic element D1, D2, D3, T1, T2, T3 or a transformer X1 or both through which the current flowing through the injection electrode 110 associated therewith flows and an ultra-low voltage charge pump circuit 220. The electronic element may include a diode D1, D2, D3, a transistor T1, T2, T3, a transformer X1 and/or a resistance 202. The power harvester 210, 220 may comprise: a pair of spaced apart electrodes 212*e* for being disposed in an orientation wherein current flows in a direction generally aligned with the direction in which the pair of spaced apart electrodes 212*e* are spaced apart, whereby a voltage V produced across the pair of spaced apart electrodes 212*e* is representative of the current flowing; and a power conversion device 220 having an input connected to the pair of spaced apart electrodes 212*e* for receiving the voltage produced thereacross for receiving electrical power therefrom, and having an output V1, V2 at which at least a portion of the electrical power received at the input thereof is provided. The current control 300 may include: a controllable electronic element T1, T2, T3, 310, S1-SN through which the current flowing in the injection electrode 110 associated therewith passes; and a control circuit 310, 320 coupled to the controllable electronic element T1, T2, T3, 310 for controlling the current flowing in the injection electrode 110 associated therewith. The controllable electronic element may include a transistor T1, T2, T3, 310, S1-SN. The controllable electronic element T1, T2, T3, 310, S1-SN may include a thermally actuatable switch S1-SN, TS4; or the control circuit 310, 320 may include a bimetallic element TS4; or the controllable electronic element T1, T2, T3, 310, S1-SN may include a thermally actuatable switch S1-S4, TS4 and the control circuit may include a bimetallic element TS4. The electronic system 200 may further comprise: a processor 400, 420 responsive to telemetry, to control signals from the surface or to both for substantially reducing the electrical current flowing through the injection electrode 110 associated therewith; or a sensor 410 providing a representation of a parameter of the injection electrode 110 associated therewith or of the subterranean formation 104 or of both; or a telemetry 130, 400 for receiving a representation of a parameter relating to the injection electrode 110 associated therewith or to the subterranean formation 104 or to both; or a combination thereof. The current control 300 may be responsive to the sensor 400 or to the telemetry 400 or to both for controlling the level of the current flowing in the injection electrode 110 associated therewith. The sensor 400 may include a sensor of electrode temperature, of bore hole fluid temperature, of bore hole fluid pressure, of bore hole fluid pH, of bore hole fluid composition, of bore hole fluid flow, of current injected by each electrode, of resistivity of the formation in the vicinity of the bore hole, and/or of porosity or change of porosity of the formation in the vicinity of the bore hole, of acoustic transmission rate, or of any combination of any two or more of the foregoing. The sensor 400 may include a sensor device 130, TS4, 410 and a processor 400, 420 for processing data produced by the sensor device 130, TS4, 410. The telemetry 130, 400 may include: a surface telemetry 130 coupled to an electrical conductor 122 carrying current between the power supply 120 and the plurality of injection electrodes 110; and an electrode telemetry 400 associated with one of the injection electrodes 110, wherein the electrode telemetry 400 is coupled to the conductor 122; wherein the surface telemetry 130 and the electrode telemetry 400 couple data to the conductor 122 and receive data from the conductor 122 for communicating data between the surface telemetry 130 and the electrode telemetry 400. The subterranean formation 104 may include an oil bearing formation, a chemical bearing formation, a water bearing formation, a contaminated water bearing formation, a rock formation, a shale formation, a sandstone formation, a carbonate formation, a soil formation, a clay formation, and formations including a combination thereof.

As used herein, the terms "electrical stimulation" and electrically stimulated" refer to, e.g., systems that employ an electro-chemical, electro-kinetic and/or electro-thermal process that generally produce the effects of formation heating, electrochemical change and/or electro-kinetics.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements. Further, the term "telemetry" is used broadly to include any communication of any information, including but not limited to commands, instructions and/or data, within, between and/or among any elements of the described arrangements.

Further, what is stated as being "optimum" or "deemed optimum" may or may not be a true optimum condition, but is the condition deemed to be desirable or acceptably "optimum" by virtue of its being selected in accordance with the decision rules and/or criteria defined by the designer and/or applicable controlling function, e.g., maintaining the electrode temperature below a predetermined maximum temperature.

In the drawing, paths for analog signals and for digital signals are generally shown as single lines and single line arrows, and may include paths for digital signals including multiple bits, however, single-bit signals, serial information and words may be transmitted over a path shown by a single line arrow.

At least portions of the present arrangement, e.g., surface control and telemetry 136 and/or electronic system 200, can be embodied in whole or in part as a computer implemented process or processes and/or apparatus for performing such computer-implemented process or processes, and can also include a tangible computer readable storage medium containing a computer program or other machine-readable instructions (herein "computer program"), wherein when the computer program is loaded into a computer or other processor (herein "computer") and/or is executed by the computer, the computer becomes an apparatus for monitoring, controlling and/or operating system 100. Storage media for containing such computer program may include, for example, floppy disks and diskettes, compact disk (CD)-ROMs (whether or not writeable), DVD digital disks, RAM and ROM memories, computer hard drives and back-up drives, external hard drives, "thumb" drives, and any other storage medium readable by a computer. The processor or processors may be implemented on a general purpose microprocessor or on a digital processor specifically configured to practice the process or processes. When a general-purpose microprocessor is employed, the computer program code configures the circuitry of the microprocessor to create specific logic circuit arrangements.

While the present invention has been described in terms of the foregoing example embodiments, variations within the scope and spirit of the present invention as defined by the claims following will be apparent to those skilled in the art. For example, while the example embodiment employs a power supply 120 that provides an essentially DC voltage and current to system 100, the arrangement described herein may be employed in systems powered by power supply that provides an AC voltage and current, or by a power supply that provides a combined AC and DC voltage and current. Where an AC power supply is employed, the frequency of the AC can be selected for providing desired power distribution and need not be at a standard power frequency, e.g., 50 Hz or 60 Hz, but may be at a substantially lower frequency.

Further, while certain high current carrying electronic elements are described as diodes, e.g., Schottky diodes, and as FETs, e.g., NMOS FETs, other electronic elements such as junction FETs (JFETs), thyristors, integrated gate bilateral thyristors (IGBTs), electro-mechanical switches, various kinds of silicon and silicon carbide diodes, and other suitable electronic elements may be employed.

Further, while an individual electronic and/or electrical element may be shown and described, plural electronic and/or electrical elements in parallel may be employed, e.g., so as to obtain a greater current carrying capacity than is provided by a single element. Likewise, plural parallel wires, conductors and/or windings may be employed for carrying high currents.

Common power bus 122 may be implemented by an actual electrical cable, e.g., a cable having insulation covering plural electrical conductors, however, current may be carried in well bore by other electrically conductive structures, e.g., by a bore hole casing, production tubing and/or a pump drive shaft. In any instance, the electrodes 110 have to be isolated electrically from each other and from an electrical power bus comprising part of the electrode string.

The present arrangement may be utilized in a wide variety of formations, including, e.g., in oil-bearing formations, in chemical bearing formations, in water bearing formations, in contaminated water bearing formations, in rock formations, in shale, sandstone and carbonate formations, in soil formations, in clay formations, and in formations having a combination of such characteristics.

Each of the U.S. Provisional Applications, U.S. patent applications, and/or U.S. patents identified herein are hereby incorporated herein by reference in their entirety, for any purpose and for all purposes irrespective of how it may be referred to herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. An electrically stimulated electrode system comprising:

a plurality of injection electrodes for being disposed along a bore hole in a subterranean formation;

a power bus in the bore hole with and coupled to said plurality of injection electrodes;

a return electrode coupled to the subterranean formation other than in the borehole with said plurality of injection electrodes;

a power supply connected to said power bus and to said return electrode, said power supply for applying electrical potential between said plurality of injection electrodes and said return electrode for causing electrical current to flow through the subterranean formation; and a plurality of electronic systems in the bore hole, wherein each electronic system is associated with said at least a predetermined one of said plurality of injection, electrodes, each said electronic system including:

a power harvester for extracting electrical power from the current flowing in at least the predetermined injection electrode for powering that one said electronic system; and a current control for controlling the current flowing through at least the predetermined injection electrode associated with that said electronic system;

each said electronic system further including:

at least one sensor providing a representation of a parameter of the predetermined injection electrode or the subterranean formation or both; or a telemetry for receiving a representation of a parameter relating to the predetermined injection electrode or the subterranean formation or both; or a combination including both said at least one sensor and said telemetry.

2. The electrically stimulated electrode system of claim 1 wherein said power harvester includes:

an electronic element or a transformer or both through which the current flowing through the injection electrode associated therewith flows; or an ultra-low voltage charge pump circuit; or the electronic element or the transformer or both through which the current flowing through the injection electrode associated therewith flows and the ultra-low voltage charge pump circuit.

3. The electrically stimulated electrode system of claim 2 wherein said electronic element includes a diode, a transistor, a transformer and/or a resistance.

4. The electrically stimulated electrode system of claim 1 wherein said current control includes:

at least one controllable electronic element through which the current flowing in the injection electrode associated therewith passes; and a control circuit coupled to said at least one controllable electronic element for controlling the current flowing in the injection electrode associated therewith.

5. The electrically stimulated electrode system of claim 4 wherein said at least one controllable electronic element includes a transistor.

6. The electrically stimulated electrode system of claim 4 wherein:

said at least one controllable electronic element includes a thermally actuatable switch; or said control circuit includes a bimetallic element; or said at least one controllable electronic element includes a thermally actuatable switch and said control circuit includes a bimetallic element.

7. The electrically stimulated electrode system of claim 1 wherein said current control is responsive to said at least one sensor or to said telemetry or to both for controlling the level of the current flowing in the injection electrode associated therewith.

8. The electrically stimulated electrode system of claim 1 wherein said at least one sensor includes a sensor of electrode temperature, of bore hole fluid temperature, of bore hole fluid pressure, of bore hole fluid pH, of bore hole fluid composition, of bore hole fluid flow, of current injected by each electrode, of resistivity of the formation in the vicinity of the bore hole, and/or of porosity or change of porosity of the formation in the vicinity of the bore hole, of acoustic transmission rate, or of any combination of any two or more of the foregoing.

9. The electrically stimulated electrode system of claim 1 wherein said at least one sensor includes at least one sensor device and a processor for processing data produced by said at least one sensor device.

10. The electrically stimulated electrode system of claim 1 wherein said telemetry includes:

a surface telemetry coupled to an electrical conductor carrying current between said power supply and the injection electrode associated therewith; and at least one electrode telemetry associated with the injection electrode associated therewith, wherein said at least one telemetry is coupled to the conductor;

wherein said surface telemetry and said at least one electrode telemetry couple data to the conductor and receive data from the conductor for communicating data between said surface telemetry and said at least one electrode telemetry.

11. The electrically stimulated electrode system of claim 1 wherein said current control for controlling the current flowing through the injection electrode associated therewith is commandable or is programmable or is commandable and programmable;

said electrically stimulated electrode system further comprising:

a control system for commanding or programming or commanding and programming each said current control to set the current flowing in the injection electrode associated therewith to a given current level, to flow at a given time, or to flow at a given level at a given time, whereby the current flowing in each injection electrode may be independently controlled and/or sequenced in time.

12. The electrically stimulated electrode system of claim 1 wherein said power harvester comprises:

a pair of spaced apart electrodes for being disposed in an orientation wherein current flows in a direction generally aligned with the direction in which said pair of spaced apart electrodes are spaced apart, whereby a voltage produced across said pair of spaced apart electrodes is representative of the current flowing; and a power conversion device having an input connected to said pair of spaced apart electrodes for receiving the voltage produced thereacross for receiving electrical power therefrom, and having an output at which at least a portion of the electrical power received at the input thereof is provided.

13. The electrically stimulated electrode system of claim 1 wherein the subterranean formation includes an oil bearing formation, a chemical bearing formation, a water bearing formation, a contaminated water bearing formation, a rock formation, a shale formation, a sandstone formation, a carbonate formation, a soil formation, a clay formation, and formations including a combination thereof.

14. The electrically stimulated electrode system of claim 1 wherein said at least one sensor includes a sensor device for sensing current flow through a material and/or for extracting power therefrom, said sensor device comprising:

a pair of spaced apart electrodes for being disposed in the material in an orientation wherein current flows in the material in a direction generally aligned with the direction in which said pair of spaced apart electrodes are spaced apart, whereby a voltage produced across said pair of spaced apart electrodes is representative of the current flowing through the material;

a power conversion device having an input connected to said pair of spaced apart electrodes for receiving the voltage produced thereacross for receiving electrical power therefrom, and having an output at which at least a portion of the electrical power received at the input thereof is provided; and an electronic processor responsive to the voltage produced across said pair of spaced apart electrodes for providing a representation of the current flowing in the material.

15. The electrically stimulated electrode system of claim 14 wherein the material includes a subterranean formation or a cement liner or both.

16. The electrically stimulated electrode system of claim 14 wherein said power conversion device includes an ultra-low voltage charge pump circuit.

17. An electrically stimulated electrode system comprising:

a plurality of injection electrodes for being disposed along a bore hole in a subterranean formation;

a power bus in the bore hole with and coupled to said plurality of injection electrodes;

a return electrode coupled to the subterranean formation;

a power supply connected to said power bus and to said return electrode, said power supply for applying electrical potential between said plurality of injection electrodes and said return electrode for causing electrical current to flow through the subterranean formation;

a plurality of electronic systems in the bore hole with and associated with each of said injection electrodes, each said electronic system including:

a power harvester for extracting electrical power from the current flowing in the injection electrode associated therewith for powering said electronic system; and a current control for controlling the current flowing through the injection electrode associated therewith, wherein said current control is commandable or is programmable or is commandable and programmable; and a control system for commanding or programming or commanding and programming each said current control to set the current flowing in the injection electrode associated therewith to a given current level, to flow at a given time, or to flow at a given level at a given time, whereby the current flowing in each of the injection electrodes may be independently controlled and/or sequenced in time.

18. The electrically stimulated electrode system of claim 17 wherein said power harvester includes:

an electronic element or a transformer or both through which the current flowing through the injection electrode associated therewith flows; or an ultra-low voltage charge pump circuit; or the electronic element or the transformer or both through which the current flowing through the injection electrode associated therewith flows and the ultra-low voltage charge pump circuit.

19. The electrically stimulated electrode system of claim 18 wherein said electronic element includes a diode, a transistor, a transformer and/or a resistance.

20. The electrically stimulated electrode system of claim 17 wherein said power harvester comprises:

a pair of spaced apart electrodes for being disposed in an orientation wherein current flows in a direction generally aligned with the direction in which said pair of spaced apart electrodes are spaced apart, whereby a voltage produced across said pair of spaced apart electrodes is representative of the current flowing; and a power conversion device having an input connected to said pair of spaced apart electrodes for receiving the voltage produced thereacross for receiving electrical power therefrom, and having an output at which at least a portion of the electrical power received at the input thereof is provided.

21. The electrically stimulated electrode system of claim 17 wherein said current control includes:

a controllable electronic element through which the current flowing in the injection electrode associated therewith passes; and a control circuit coupled to said controllable electronic element for controlling the current flowing in the injection electrode associated therewith.

22. The electrically stimulated electrode system of claim 21 wherein said controllable electronic element includes a transistor.

23. The electrically stimulated electrode system of claim 21 wherein:

said controllable electronic element includes a thermally actuatable switch; or said control circuit includes a bimetallic element; or said controllable electronic element includes a thermally actuatable switch and said control circuit includes a bimetallic element.

24. The electrically stimulated electrode system of claim 17 wherein said electronic system further comprises:

a processor responsive to telemetry, to control signals from the surface or to both for substantially reducing the electrical current flowing through the injection electrode associated therewith; or a sensor providing a representation of a parameter of the injection electrode associated therewith or of the subterranean formation or of both; or a telemetry for receiving a representation of a parameter relating to the injection electrode associated therewith or to the subterranean formation or to both; or a combination thereof.

25. The electrically stimulated electrode system of claim 24 wherein said current control is responsive to said sensor or to said telemetry or to both for controlling the level of the current flowing in the injection electrode associated therewith.

26. The electrically stimulated electrode system of claim 24 wherein said sensor includes a sensor of electrode temperature, of bore hole fluid temperature, of bore hole fluid pressure, of bore hole fluid pH, of bore hole fluid composition, of bore hole fluid flow, of current injected by each electrode, of resistivity of the formation in the vicinity of the bore hole, and/or of porosity or change of porosity of the formation in the vicinity of the bore hole, of acoustic transmission rate, or of any combination of any two or more of the foregoing.

27. The electrically stimulated electrode system of claim 24 wherein said sensor includes a sensor device and a processor for processing data produced by said sensor device.

28. The electrically stimulated electrode system of claim 24 wherein said telemetry includes:

a surface telemetry coupled to an electrical conductor carrying current between said power supply and said plurality of injection electrodes; and an electrode telemetry associated with one of said injection electrodes, wherein said electrode telemetry is coupled to the conductor;

wherein said surface telemetry and said electrode telemetry couple data to the conductor and receive data from the conductor for communicating data between said surface telemetry and said electrode telemetry.

29. The electrically stimulated electrode system of claim 17 wherein the subterranean formation includes an oil bearing formation, a chemical bearing formation, a water bearing formation, a contaminated water bearing formation, a rock formation, a shale formation, a sandstone formation, a carbonate formation, a soil formation, a clay formation, and formations including a combination thereof.

* * * * *

UNITED STATES PATENT AND TRADEMARK OFFICE

CERTIFICATE OF CORRECTION

PATENT NO. : 9,328,597 B2
APPLICATION NO. : 13/438220
DATED : May 3, 2016
INVENTOR(S) : Marian Morys It is certified that error appears in the above-identified patent and that said Letters Patent is hereby corrected as shown below:

In the claims,

Column 23, line 34, delete "said" following "with";

Column 23, line 35, delete the "," following "injection".

Signed and Sealed this
Twelfth Day of July, 2016

Michelle K. Lee

Michelle K. Lee
*Director of the United States Patent and Trademark Office*